US008103181B2

(12) United States Patent
Ishibashi et al.

(10) Patent No.: US 8,103,181 B2
(45) Date of Patent: Jan. 24, 2012

(54) IMAGE FORMING APPARATUS AND METHOD OF ADJUSTING CHARGE BIAS

(75) Inventors: Hitoshi Ishibashi, Kanagawa (JP); Kohta Fujimori, Kanagawa (JP); Shin Hasegawa, Kanagawa (JP); Yushi Hirayama, Kanagawa (JP); Nobutaka Takeuchi, Kanagawa (JP); Shinji Kato, Kanagawa (JP); Kayoko Tanaka, Tokyo (JP); Naoto Watanabe, Kanagawa (JP); Kentaroh Tomita, Kanagawa (JP); Satoru Komatsubara, Kanagawa (JP); Akio Kosuge, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/833,787

(22) Filed: Jul. 9, 2010

(65) Prior Publication Data

US 2010/0278549 A1 Nov. 4, 2010

Related U.S. Application Data

(62) Division of application No. 11/834,354, filed on Aug. 6, 2007, now Pat. No. 7,778,560.

(30) Foreign Application Priority Data

Aug. 4, 2006 (JP) ..... 2006-213758

(51) Int. Cl.
*G03G 15/02* (2006.01)

(52) U.S. Cl. ..... 399/50

(58) Field of Classification Search ..... 399/31, 399/50, 174, 176; 361/225
See application file for complete search history.

(56) References Cited

U.S. PATENT DOCUMENTS

| | | | | |
|---|---|---|---|---|
| 5,146,280 | A * | 9/1992 | Kisu | 399/176 |
| 5,457,522 | A | 10/1995 | Haneda et al. | |
| 5,649,268 | A * | 7/1997 | Maebashi et al. | 399/168 |
| 6,360,065 | B1 * | 3/2002 | Ishibashi et al. | 399/174 |
| 6,539,184 | B2 | 3/2003 | Shimura et al. | |
| 6,591,077 | B2 | 7/2003 | Yanagisawa et al. | |
| 6,775,511 | B2 | 8/2004 | Kosuge | |
| 6,961,529 | B2 | 11/2005 | Kosuge | |
| 6,990,305 | B2 | 1/2006 | Kosuge et al. | |
| 6,999,690 | B2 * | 2/2006 | Watanabe et al. | 399/50 |
| 7,035,560 | B2 | 4/2006 | Okano et al. | |
| 7,113,727 | B2 | 9/2006 | Kosuge et al. | |

(Continued)

FOREIGN PATENT DOCUMENTS

CN 1645263 7/2005

(Continued)

OTHER PUBLICATIONS

Office Action issued Jun. 3, 2011, in Japanese Patent Application No. 2006-213758.

*Primary Examiner* — Robert Beatty
(74) *Attorney, Agent, or Firm* — Oblon, Spivak, McClelland, Maier & Neustadt, L.L.P.

(57) ABSTRACT

An image forming apparatus includes an image carrier configured to carry an image and a charger to which a direct current voltage overlapped with an AC voltage is applied as a charging bias to charge the image carrier. The charger is positioned in contact or contactlessly with the image carrier. The AC voltage applied to the charger in an adjustment of the AC voltage is not less than twice a charging start voltage Vth at which the image carrier starts to be charged.

19 Claims, 24 Drawing Sheets

U.S. PATENT DOCUMENTS

| | | | |
|---|---|---|---|
| 7,139,501 | B2 | 11/2006 | Takami et al. |
| 7,139,511 | B2 | 11/2006 | Ishibashi |
| 7,155,146 | B2 | 12/2006 | Kosuge |
| 7,162,173 | B2 | 1/2007 | Motohashi et al. |
| 7,630,659 | B2 | 12/2009 | Uchitani et al. |
| 2004/0071476 | A1 | 4/2004 | Iwasaki et al. |
| 2005/0175374 | A1 | 8/2005 | Kosuge |
| 2006/0239704 | A1 | 10/2006 | Ishibashi |
| 2006/0239705 | A1 | 10/2006 | Ishibashi |
| 2007/0104513 | A1 | 5/2007 | Kosuge et al. |

FOREIGN PATENT DOCUMENTS

| | | | | |
|---|---|---|---|---|
| JP | 03-240076 | | | 10/1991 |
| JP | 11254757 | A | * | 9/1999 |
| JP | 2001005237 | A | * | 1/2001 |
| JP | 2001-201921 | | | 7/2001 |
| JP | 2004-4654 | | | 1/2004 |
| JP | 2004-021033 | | | 1/2004 |
| JP | 2004-62062 | | | 2/2004 |
| JP | 3748764 | | | 12/2005 |

* cited by examiner

IMAGE FORMING APPARATUS AND METHOD OF ADJUSTING CHARGE BIAS

CROSS-REFERENCE TO RELATED APPLICATIONS

This application is a divisional of U.S. Ser. No. 11/834,354 filed Aug. 6, 2007, now U.S. Pat. No. 7,778,560 which claims priority under 35 U.S.C. 119 to Japanese Application No. 2006-213758 filed Aug. 4, 2006, the entire contents of both of which are incorporated herein by reference.

BACKGROUND OF THE INVENTION

1. Field of the Invention

The present invention relates to an image forming apparatus and a method of adjusting a charge bias.

2. Discussion of the Background

An image forming apparatus such as a copying machine, a printer, and a facsimile machine is provided with an image carrier on which an image is formed, a charger, etc. The image forming apparatus forms an electrostatic latent image on the image carrier corresponding to image information obtained through light scanning or sent from a host computer. The electrostatic latent image is developed into a visible image and then transferred onto a recording medium (e.g., sheet).

Before image forming, the charger uniformly charges a surface of the image carrier. Known charging methods include a non-contact charging method using a corona charger, etc., and a roller charging method or contact charging method in which a charging roller contacts the image carrier.

A related-art charging roller includes an elastic layer and a high-resistivity layer provided on a core metal. A voltage is applied to the core metal to allow the charging roller to charge the surface of the image carrier. The contact charging method is preferred in recent years because less ozone is generated compared with the non-contact corona method.

However, debris (e.g., toner, paper dust, etc.), which causes unevenness of charging on the surface of the image carrier, is likely to adhere to the image carrier in the contact charging method. Therefore, a non-contact roller charging method, in which discharging is induced in a tiny gap provided between the image carrier and the charging roller, has been proposed.

Methods to apply a charging bias to a charging roller include a direct current (DC) application method and an alternating current (AC) application method. In the DC application method, a DC voltage that is controlled in a constant-voltage method (constant-voltage controlled DC voltage) is used. In the AC application method, an AC voltage that is controlled in a constant-voltage method (constant-voltage controlled AC voltage) or a constant-current method (constant-current controlled AC voltage) is overlapped on a constant-voltage controlled DC voltage.

In the AC application method, it is necessary to consider changes in surface resistance of the charging roller. For example, it becomes difficult to induce discharging when the surface resistance of the charging roller increases. By contrast, when the surface resistance of the charging roller decreases, an amount of the discharge increases and deterioration of the image carrier is accelerated. Further, image failure in a high-temperature and high-humidity environment may be generated by a discharge product. Therefore, it is necessary to adjust a peak-to-peak voltage of the AC voltage according to changes in properties of the charging roller in the AC application method.

As an example, the following method of adjusting a charging bias has been proposed: When a DC voltage is applied to a charging roller, a voltage at which discharging to an image carrier starts is referred to as a discharge start voltage or charging start voltage Vth. While image forming is not performed, at least an AC voltage value having a peak-to-peak voltage lower than twice the discharge start voltage Vth is applied to the charging roller and a supplied AC value is measured. Further, while image forming is not performed, at least two AC voltage values having different peak-to-peak voltages equal to or greater than twice the discharge start voltage Vth are applied to the charging roller and supplied AC values are respectively measured. Based on the measured AC values, a peak-to-peak voltage of an AC voltage applied to the charging roller in a subsequent image formation is adjusted.

In the non-contact roller charging method, it is necessary to consider changes in size of the gap, which affects discharging.

In one method of adjusting a charge bias, constant-voltage controlled AC voltages having different peak-to-peak voltages are applied to a charging roller and a current value supplied to the charging roller is measured. The current supplied to the charging roller when a surface potential of an image carrier becomes substantially equal to a DC voltage applied to the charging roller is referred to as a saturated current value. The peak-to-peak voltage is adjusted to such a value that the current value supplied to the charging roller becomes the saturated current value (actual value).

FIG. 1 illustrates a procedure of a related-art method of adjusting the peak-to-peak voltage of an AC voltage. At S101, an AC voltage having a certain peak-to-peak voltage is applied to a charging member as a charging bias, and an AC value supplied to the charging member is measured. At S102, it is determined whether or not the measured current value is within a target range. If the measured current value is not within the target range, an AC voltage having a different peak-to-peak voltage is applied to the charging member and an AC value supplied to the charging member is measured at S103. S102 and S103 are repeated until a supplied AC value in the target range is obtained. The above-described adjustment process is performed during a warm-up time of an image forming apparatus.

SUMMARY OF THE INVENTION

Various exemplary embodiments disclosed herein describe an image forming apparatus.

In the exemplary embodiments, an image forming apparatus includes an image carrier configured to carry an image and a charger to which a direct current voltage overlapped with an AC voltage is applied as a charging bias to charge the image carrier. The charger is positioned in contact or contactlessly with the image carrier. The AC voltage applied to the charger in an adjustment of the AC voltage is not less than twice a charging start voltage Vth at which the image carrier starts to be charged.

In an exemplary embodiment, an image forming apparatus includes an image carrier configured to carry an image, a charger to which a direct current voltage overlapped with an AC voltage is applied as a charging bias to charge the image carrier, and a controller. The charger is positioned in contact or contactlessly with the image carrier. The controller is configured to adjust the AC voltage by performing a sequence including detecting an output value of the AC voltage applied to the charger, determining whether or not a detected output value is within a target range, and switching the alternating current when the detected output value is out of the target range. The controller performs the sequence at least once in an adjustment of the AC voltage and performs the adjustment multiple times until the detected output value enters the target range.

In an exemplary embodiment, an image forming apparatus includes an image carrier configured to carry an image and a charger to which a direct current voltage overlapped with an AC voltage is applied as a charging bias to charge the image carrier. The charger is positioned in contact or contactlessly with the image carrier. The AC voltage is adjusted in separate adjustment processes of detecting an output value of the AC voltage applied to the charger, determining whether or not a detected output value is within a target range including a tolerance to a target value, and switching the AC voltage when the detected output value is out of the target range.

BRIEF DESCRIPTION OF THE DRAWINGS

Various objects, features, and attendant advantages of the exemplary embodiments will be more fully appreciated as the same becomes better understood from the detailed description when considered in connection with the accompanying drawings, in which like reference characters designate like corresponding parts throughout and wherein.

DETAILED DESCRIPTION OF THE INVENTION

Figure 1:
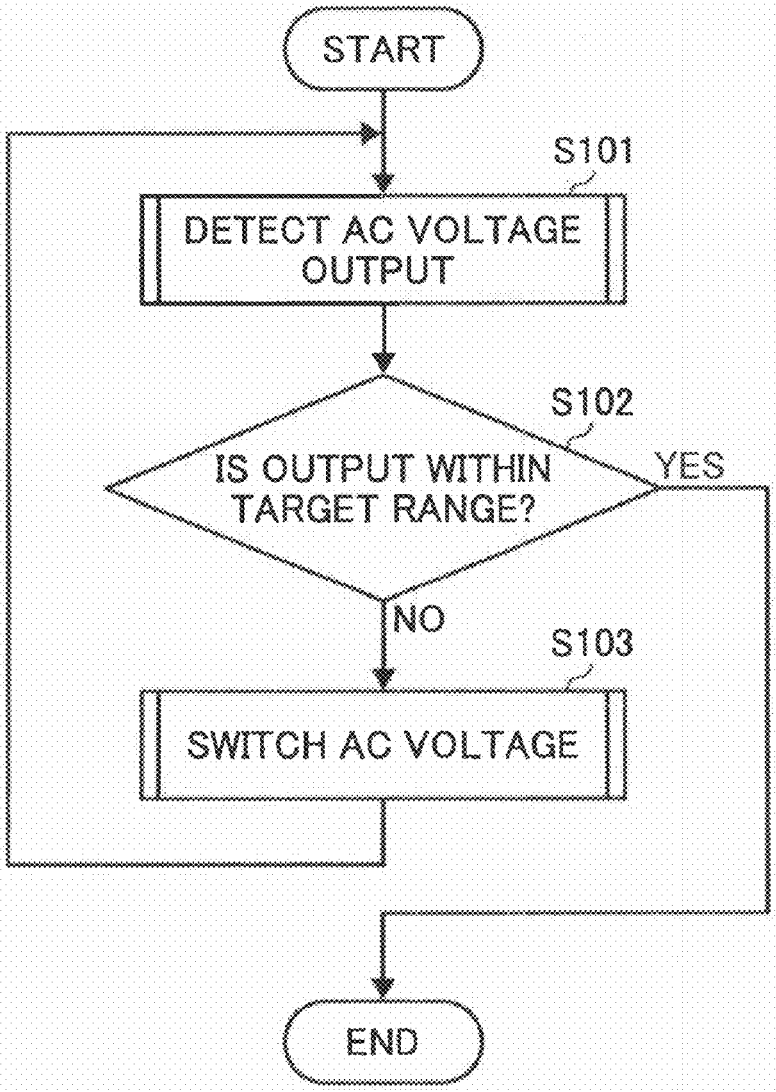
FIG. 1 RELATED ART
FIG. 1 is an example flowchart of a related-art adjustment of an alternating current (AC) voltage.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

Figure 2:
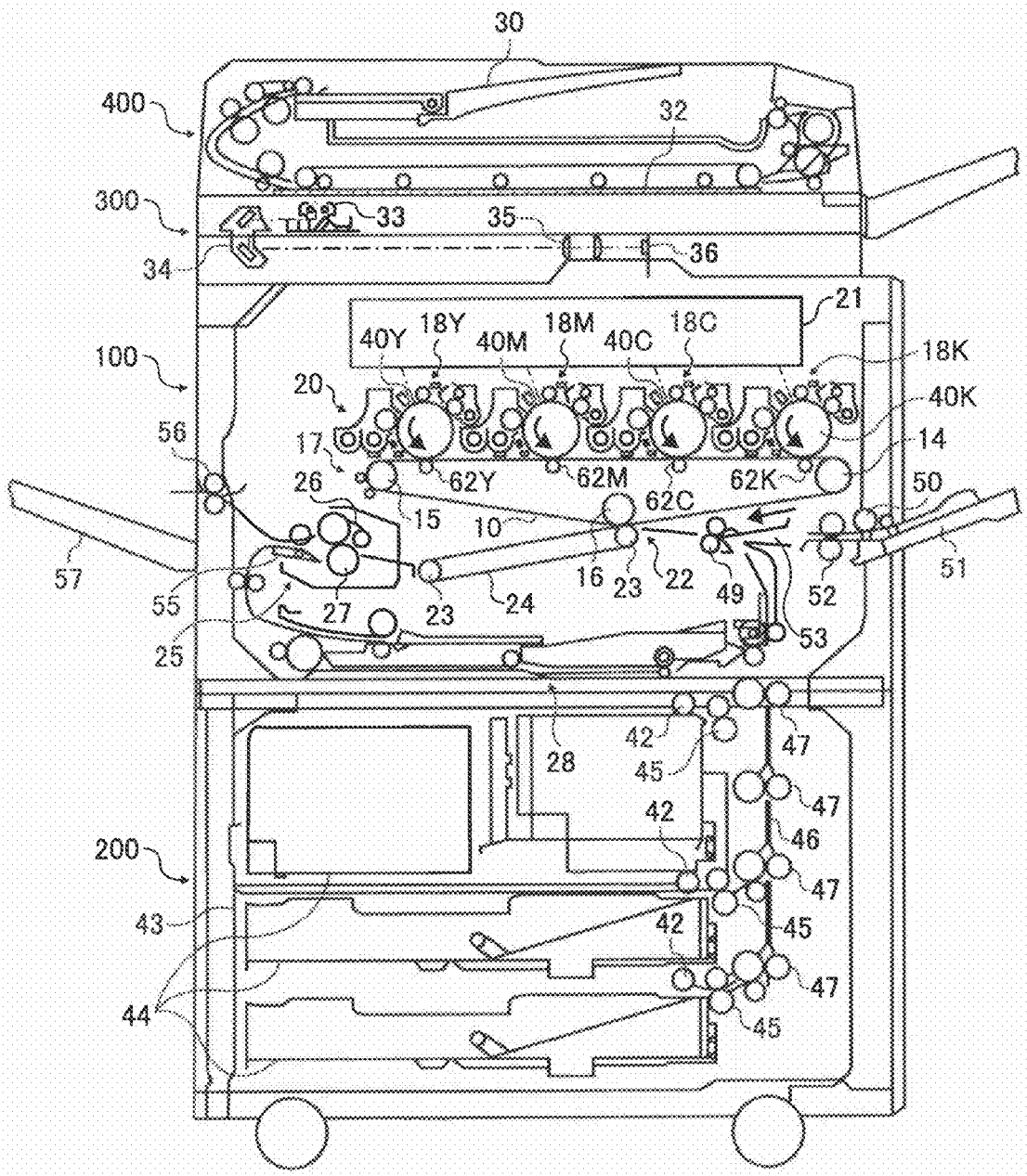
FIG. 2 is a schematic diagram of an image forming apparatus according to an exemplary embodiment.

Referring now to the drawings, wherein like reference numerals designate identical or corresponding parts throughout the several views, an example of an image forming system according to an exemplary embodiment is described. Referring to FIG. 2, reference numeral 100 represents an image forming apparatus, reference numeral 200 represents a sheet feeder on which the image forming apparatus 100 is mounted, reference numeral 300 represents a scanner provided over the image forming apparatus 100, and reference numeral 400 represents an automatic document feeder (ADF) provided over the scanner 300. In an exemplary embodiment, the image forming apparatus 100 is a tandem type electronographic copier employing an intermediate transfer (indirect transfer) method.

The image forming apparatus 100 includes an intermediate transfer belt 10 as an image carrier. The intermediate transfer belt 10 is stretched around support rollers 14, 15, and 16 and rotates clockwise in FIG. 2. The image forming apparatus 100 further includes an intermediate transfer belt cleaner 17 at the left of the support roller 15 in FIG. 2, a tandem unit 20, and an irradiator 21 (laser writing device). The intermediate transfer belt cleaner 17 removes toner remaining on the intermediate transfer belt 10 after an image is transferred therefrom. The tandem unit 20 faces an upper surface of apart of the intermediate transfer belt 10 stretched between the support rollers 14 and 15. The tandem unit 20 includes image-forming units 18Y, 18C, 18M, and 18K that are arranged along a moving direction of the intermediate transfer belt 10 (belt moving direction). Each of the image-forming units 18Y, 18C, 18M, and 18K includes one of photoreceptors 40Y, 40C, 40M, and 40K that are image carriers. The image forming apparatus further includes a drum motor, not shown, to drive the one of the photoreceptors 40Y, 40C, 40M, and 40K to rotate.

In an exemplary embodiment, the support roller 16 is a driving roller. The irradiator 21 may include a laser diode (LD) and emit a laser light to each of the photoreceptors 40Y, 40C, 40M, and 40K to formed latent images thereon. The latent images are developed into yellow, cyan, magenta, and black toner images, respectively, and transferred onto the intermediate transfer belt 10.

The image forming apparatus further includes a second transferer 22, a fixer 25, a sheet reverser 28, and intermediate transfer rollers 62Y, 62C, 62M, and 62K. The second transferer 22 is located at an opposite side of the tandem unit 20 with respect to the intermediate transfer belt 10. The secondary transferer 22 includes a pair of rollers 23 and a secondary transfer belt 24 stretched around the pair of rollers 23. The secondary transfer belt 24 is pressed to the support roller 16 via the intermediate transfer belt 10 and forms a secondary transfer nip with the intermediate transfer belt 10. The secondary transferer 22 transfers the toner images from the intermediate transfer belt 10 onto a sheet of recording medium at the secondary transfer nip. The transfer belt 24 has a function to transport the sheet to the fixer 25. Alternatively, the secondary transferer 22 may be a transfer roller or a non-contact transfer charger. In this case, another component to transport the sheet is required.

The fixer 25 is provided at the left of the secondary transferer 22 in FIG. 2 and fixes the toner image on the sheet. The fixer 25 includes a fixing belt 26 and a pressure roller 27. The pressure roller 27 presses against the fixing belt 26. The sheet reverser 28 is located beneath the secondary transferer 22 and the fixer 25, parallel to the tandem unit 20. The sheet reverser 28 reverses the sheet to eject the sheet upside down or to form images on both sides of the sheet.

The intermediate transfer rollers 62Y, 62C, 62M, and 62K are primary transferers to transfer the toner images from the photoreceptors 40Y, 40C, 40M, and 40K onto the intermediate transfer belt 10, and are placed at positions facing one of the photoreceptors 40Y, 40C, 40M, and 40K via the intermediate transfer belt 10.

The image forming apparatus 100 further includes a pair of registration rollers 49, a feeding roller 50, a manual feed tray 51, a pair of separation rollers 52, a manual feed path 53, a switching claw 55, a pair of ejection rollers 56, and an ejection tray 57. The manual feed tray 51 is attached to a side of the image forming apparatus 100. The image forming apparatus 100 further includes a control panel, not shown, with which a user operates the image forming system.

The scanner 300 reads image information of an original document and includes a contact glass 32, a first carriage 33, a second carriage 34, an imaging lens 35, and a reading sensor 36. The first carriage 33 includes a light source. The second carriage 34 includes a mirror. The ADF 400 includes a document table 30 and may automatically forward the original document placed on the document table 30 to the contact glass 32.

The sheet feeder 200 includes a plurality of feeding rollers 42, a paper bank 43, a plurality of separation rollers 45, a sheet feeding path 46, and a plurality of conveyance rollers 47. The paper bank 43 includes a plurality of sheet cassettes 44. The sheet feeder 200 may send a sheet of transfer media to the image forming apparatus 100.

Processes to read an original document by the scanner 300 for copying are described. A user places the original document on the document table 30. Alternatively, the user opens the ADF 400, places the original document on the contact glass 32 of the scanner 300, and closes the ADF 400 to hold the sheet with the ADF 400.

When the user pushes a start button, not shown, the original document on the document table 30 is forwarded onto the contact glass 32. Alternatively, the scanner 300 is immediately driven to read the image information of the original document when the original document is placed on the contact glass 32.

The scanner 300 starts to run the first carriage 33 and the second carriage 34. The light source of the first carriage 33 emits light to the original document. The light is reflected by a surface of the original document. The reflected light is sent to the second carriage 34. The mirror in the second carriage 34 further reflects the light so as to direct the light to the reading sensor 36 through the imaging lens 35. Thus, the reading sensor 36 reads image information on the original document.

Along with the above-described reading processes, a driving motor, not shown, rotates the driving roller 16. Accordingly, the intermediate transfer belt 10 rotates clockwise in FIG. 2, which causes the support rollers 14 and 15 (driven rollers) to rotate. Simultaneously with the above-described processes, the photoreceptors 40Y, 40C, 40M, and 40K in the image-forming units 18 start to rotate, respectively. After the surfaces of the photoreceptors 40Y, 40C, 40M, and 40K are uniformly charged, the irradiator 21 applies a laser light according to the image information of respective colors to the photoreceptors 40Y, 40C, 40M, and 40K. With the irradiation, electrostatic latent images are formed on the surfaces of the photoreceptors 40Y, 40C, 40M, and 40K. The electrostatic latent images are developed with toners into single color toner images. The toner images are sequentially transferred from the photoreceptors 40Y, 40C, 40M, and 40K and superimposed on one another on the intermediate transfer belt 10. Thus, a synthesized color image (toner image) is formed on the intermediate transfer belt 10.

Along with the above-described image forming, one of the feeding rollers 42 in the sheet feeder 200 selectably rotates to send a sheet from a corresponding sheet cassette 44. A pair of separation rollers 45 corresponding to the feeding roller 42 ensures that the sheets are sent one by one to a transport path 46. The conveyance rollers 47 forward the sheet to a transport path 48 in the image forming apparatus 100. Alternatively, the user may use the manual feed tray 51. The feeding roller 50 rotates to send out a sheet from the manual feed tray 51. The pair of separation rollers 52 separates the sheets to send the sheets one by one to the manual feed path 53.

The sheet is transported along the transport path 48 or the manual feed path 53, until the pair of registration rollers 49 stops the sheet by sandwiching a leading edge of the sheet therebetween. The pair of registration rollers 49 may timely forward the sheet to the secondary transfer nip so that the sheet may overlap the toner image on the intermediate transfer belt 10. While the sheet passes through the secondary transfer nip, the secondary transferer 22 transfers the toner image onto a first side of the sheet.

The secondary transfer belt 24 forwards the sheet to the fixer 25 where the image is fixed on the sheet with heat and pressure. After the fixing process, the switching claw 55 switches a sheet ejection route between the pair of ejection rollers 56 and the reverser 28. The pair of ejection rollers 56 ejects the sheet onto the ejection tray 57. However, when the sheet is sent to the reverser 28, the sheet is reversed and then sent to the secondary transfer nip, where an image is recorded on a second side of the sheet. After that, the ejection roller 56 ejects the sheet onto the ejection tray 57. When images are formed on two or more sheets, the above-described processes are repeated.

The cleaner 17 removes the toner remaining on the intermediate transfer belt 10 after the image is transferred therefrom in preparation for subsequent image forming by the tandem unit 20. Although the registration rollers 49 are generally grounded, a bias may be applied to the registration rollers 49 to remove paper dust, etc., from the sheet.

Figure 3:
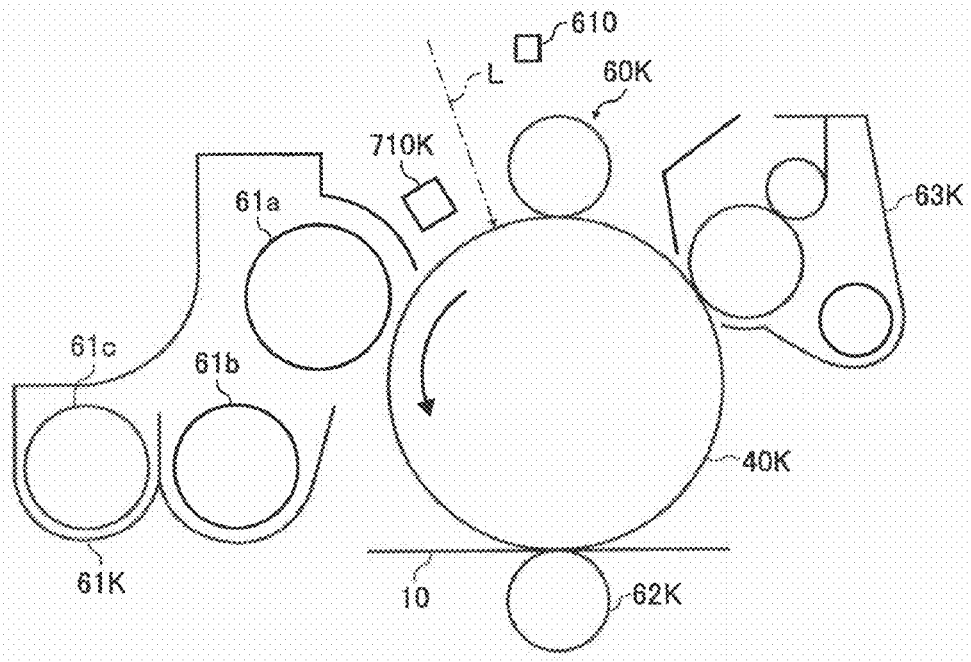
FIG. 3 is an enlarged diagram of an image forming unit included in the image forming apparatus of FIG. 2.

Next, the image-forming unit 18K for black is described, referring to FIG. 3. The image-forming units 18Y, 18M, and 18C are configured similarly to the image-forming unit 18K and descriptions thereof are thus omitted.

The image-forming unit 18K includes a charging device 60K, a potential sensor 710K, a developing unit 61K, a photoreceptor cleaner 63K, and a discharger, not shown, around the drum-shaped photoreceptor 40. The potential sensor 710K detects a potential on the surface of the photoreceptor 40. The developing unit 61K may include a developing roller 61*a* facing the photoreceptor 40 and screws 61*b* and 61*c* that agitate and transport a developer (e.g., toner).

The image forming apparatus 100 may further include an environment detector 610 near the charging device 60K to detect environmental conditions.

The photoreceptor 40K is rotated by a driving motor (not shown) during image forming. After the charging device 60K uniformly charges the surface of the photoreceptor 40, the irradiator 21 (in FIG. 2) applies a writing light (laser light) L to the surface of the photoreceptor 40K, by which an electrostatic latent image is formed thereon. The image information read by the scanner 300 is sent as an image signal to an image processor, not shown, that performs image processing (e.g., color transformation) of the image signal and outputs black, yellow, magenta, and cyan image signals to the irradiator 21. The irradiator 21 converts the black image signal into an optical signal and exposes the photoreceptor 40K based on the optical signal to form an electrostatic latent image.

The developing unit 61K develops the electrostatic latent image into a black toner image. The primary transfer roller 62K transfers the toner image from the photoreceptor 40K onto the intermediate transfer belt 10 in a primary transfer process. The photoreceptor cleaner 63 cleans the surface of the photoreceptor 40K after the primary transfer process. The discharger, not shown, removes potentials remaining on the surface of the photoreceptor 40K in preparation for subsequent image forming.

Similarly, the image-forming units 18Y, 18M, and 18C form yellow, magenta, and cyan toner images on the photoreceptors 40Y, 40M, and 40C, respectively. The toner images are superimposed on the intermediate transfer belt 10 in the primary transfer process.

In an exemplary embodiment, the image forming apparatus 100 offers a full color mode and monochrome mode. In the full color mode, all of the photoreceptors 40K, 40Y, 40M, and 40C contact the intermediate transfer belt 10. In the monochrome modes for forming a monochrome image (a black toner image), the photoreceptors 40Y, 40M, and 40C do not contact the intermediate transfer belt 10.

The image forming apparatus 100 may further include an automatic color change mode, in which the image forming apparatus 100 detects whether the image of the original document read by the scanner 300 is in monochrome or in full color and automatically switches between the monochrome mode and the full color mode. The monochrome mode may be carried out using either of two different methods. In a first method, the photoreceptors 40Y, 40M, and 40C are moved away from the intermediate transfer belt 10 during image forming. In a second method, the developing units 61Y, 61M, and 61C are stopped. In the automatic color change mode, the monochrome mode is carried out using the second method.

The user may select one of the monochrome mode, the full color mode, and the automatic color change mode, and input the selected mode with an input part provided in the control panel.

Allowing the user to select the modes provides the following advantages. For example, if the user desires to make a copy of an original document including a color image in monochrome, the user may obtain a monochrome copy as desired by selecting the monochrome mode. Further, deterioration of the photoreceptors 40Y, 40M, and 40C may be prevented or reduced because the photoreceptors 40Y, 40M, and 40C are moved away from the intermediate transfer belt 10 when the user selects the monochrome mode.

When the user selects the full color mode, the mode is not switched to the monochrome mode even when the original document is in monochrome, unlike in the automatic color change mode. Therefore, the image forming apparatus 100 prints original documents including a color page and a monochrome page in succession faster in the full color mode than in the automatic color change mode. The user may obtain printed sheets of original documents including both a color page and a monochrome page quickly by selecting the full color mode.

The charging devices (e.g., charging device 60K) included in the image-forming units 18K, 18Y, 18M, and 18C are configured similarly and function similarly. Hereinafter, a charging device 60 refers to one of the above-described charging devices. Likewise, a photoreceptor 40 refers to one of the photoreceptors 40K, 40Y, 40M, and 40C.

Figure 4:
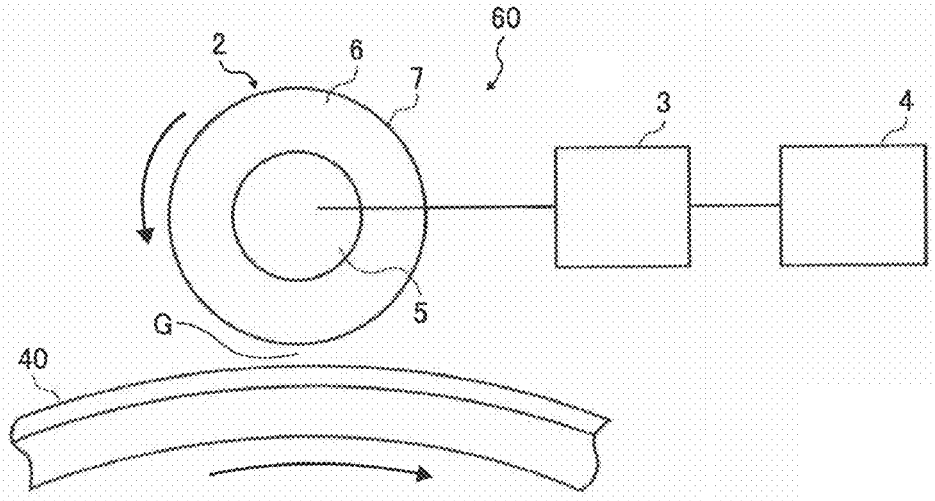
FIG. 4 illustrates a configuration around a charging device.

The charging device 60 is described in detail below. FIG. 4. illustrates an example of the charging device 60. The charging device 60 includes a charging roller 2 (charger) located at a position facing the photoreceptor 40 across a tiny gap G, a power source 3 to apply a voltage to the charging roller 2, and a controller 4 to control the power source 3. The charging roller 2 may include an elastic layer 6 provided on an outer circumference of a conductive core metal 5 and a high-resistivity layer 7 provided on an outer circumference of the elastic layer 6. Alternatively, the charging roller 2 may include a hard resin outer layer instead of the elastic layer 6. The high-resistivity layer 7 may be omitted. The charging roller 2 preferably includes an outer layer including a conductive material of medium resistivity.

The environment detector 610 may detect a temperature on the charging roller 2 and a humidity around the charging roller 2. Alternatively, the image forming apparatus 100 may include a thermistor contacting an outer circumference of the charging roller 2 as an environment sensor. Alternatively, a thermometer and a hygrometer may serve as an environment sensor.

Figure 5:
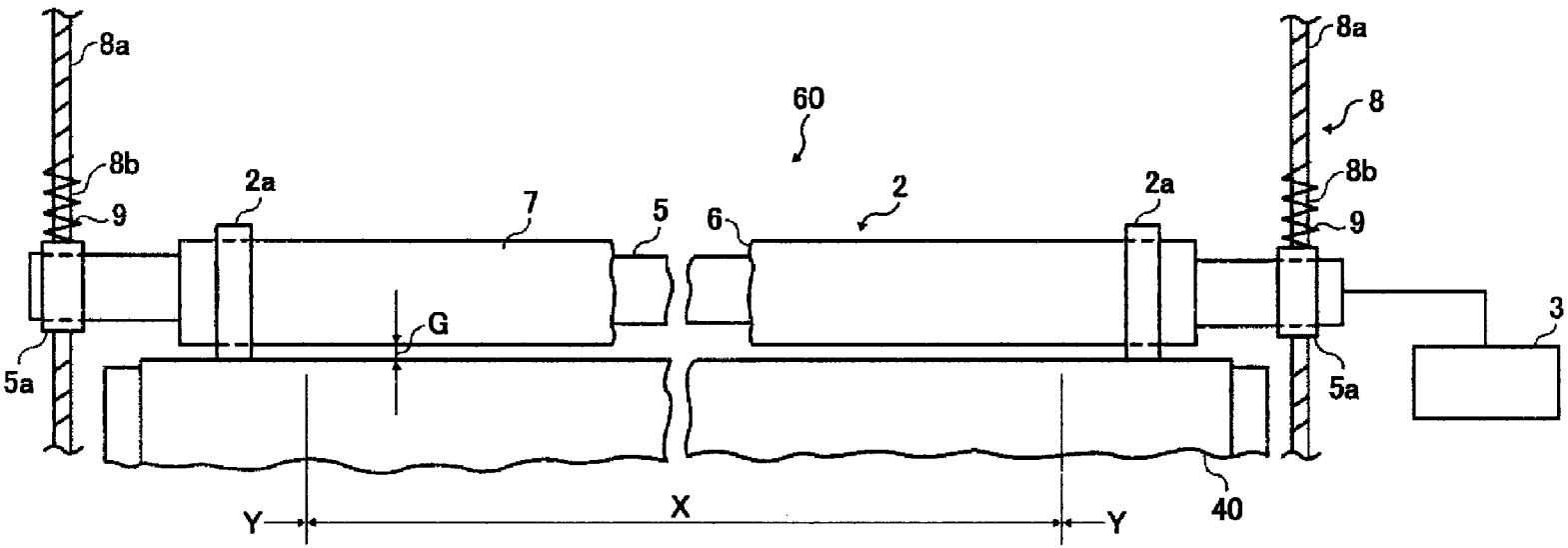
FIG. 5 illustrates a charging roller and a support structure thereof.

FIG. 5 illustrates details of the charging device 60. As illustrated in FIG. 5, the charging device 60 may further include spacers 2*a* that are gap forming members attached to the charging roller 2, bearings 5*a*, a casing 8, and compression springs 9. The photoreceptor 40 includes an image-forming region X and non-image-forming regions Y located on outer sides of the image-forming region X in an axial direction thereof. The casing 8 includes side plates 8*a* in which slots 8*b* are respectively provided.

The charging roller 2 is located parallel to the photoreceptor 40 in the axial directions thereof. Spacers 2*a* are attached at each end portion of the charging roller 2 in the axial direction that faces each non-image-forming region Y. The spacers 2*a* contact the non-image-forming regions Y of the photoreceptor 40 and the charging roller 2 is rotated by the rotation of the photoreceptor 40. The gap G between the image-forming region X and the charging roller 2 is kept by the spacers 2*a* to a predetermined or desirable size, or distance. Each of the spacers 2*a* includes an insulator or a material having a volume resistivity not lower than a volume resistivity of the high-resistivity layer 7. In an exemplary embodiment, the spacers 2*a* are formed of tapes.

Both ends of the core metal 5 of the charging roller 2 are rotatably held by the bearings 5*a*, respectively. Each of the bearings 5*a* engages the slot 8*b* provided in the side plate 8*a* and is slidable in a direction to contact or depart from the photoreceptor 40. Each of the compression springs 9 presses the bearing 5*a* toward the surface of the photoreceptor 40, preferably with such pressure as to allow the charging roller 2 to be rotated at the same or similar liner speed at which the photoreceptor 40 rotates. With the above-described configuration, the spacers 2*a* contact the surface of the photoreceptor 40 at a predetermined or desirable pressure and the charging roller 2 is desirably rotated by the rotation drive of the photoreceptor 40. Further, the tiny gap G may be maintained with a higher degree of accuracy. The charging roller 2 may be driven by a driving motor, not shown.

The core metal 5 of the charging roller 2 is electrically connected to the power source 3 that applies a predetermined or desirable charging bias to the charging roller 2. With the charging bias, a discharge phenomenon occurs in a space between the charging roller 2 and the surface of the photoreceptor 40, by which at least the image-forming region X of the photoreceptor 40 is charged to a predetermined or desirable polarity.

Figure 6:
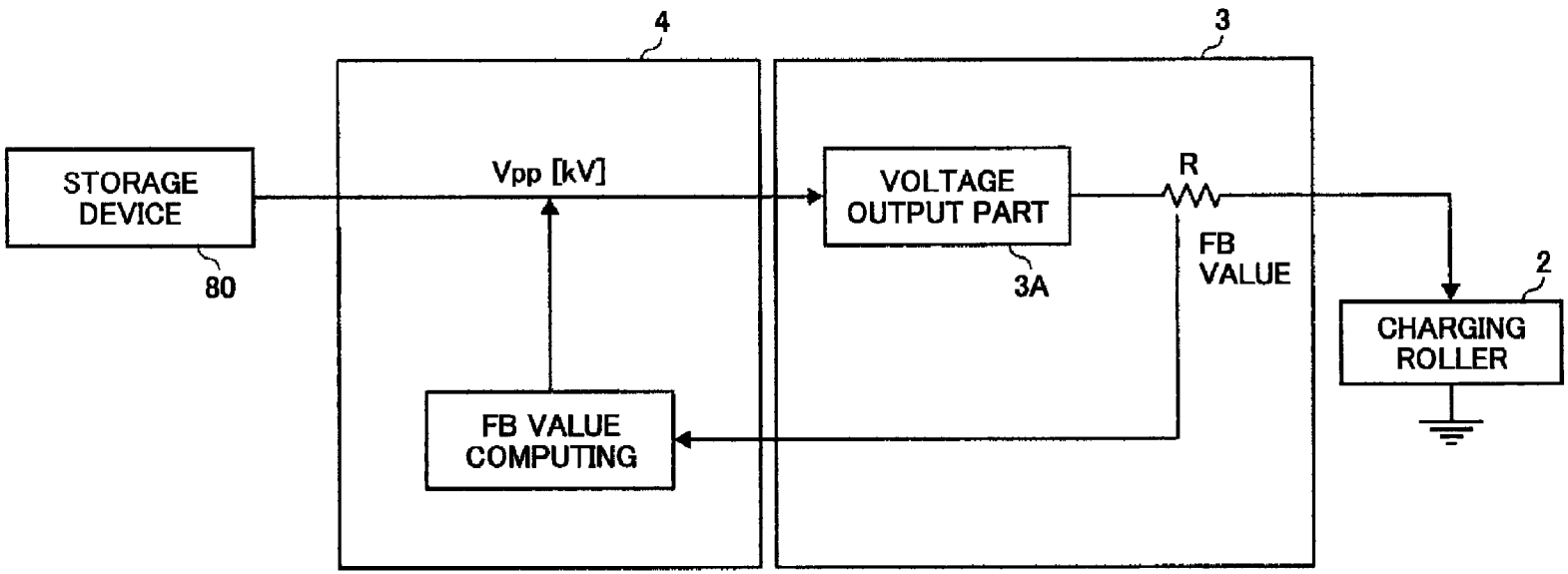
FIG. 6 is a functional block diagram of a power source and a controller.

FIG. 6 is a block diagram illustrating functions of the power source 3 and the controller 4. The controller 4 is provided in the charging device 60, in an exemplary embodiment. A controller to control a current in the charging device 60 or a controller in the image forming apparatus 100 to control image forming may function as the controller 4. The power source 3 includes a voltage output part 3A and a fixed micro resistance R.

The controller 4 communicates with a storage device 80 storing a charging bias direct-current (DC) voltage value, a peak-to-peak voltage Vpp of an alternating current (AC) voltage, a wavelength of the AC voltage, etc. The controller 4 reads out the charging bias values from the storage device 80 and outputs the charging bias values to the power source 3 as signals.

The power source 3 applies the charging bias to the charging roller 2 from the voltage output part 3A based on the signals. The power source 3 is configured to determine a current value Icac supplied to the charging roller 2 by measuring voltages at both ends of the micro resistance R. The power source 3 converts the current value Icac into a voltage and outputs the voltage as a feedback voltage value (FB value) to the controller 4.

The size of gap G, that is, the distance between the charging roller 2 and the photoreceptor 40, may vary cyclically or randomly, due to eccentricities, vibrations, etc., of the charging roller 2 and the photoreceptor 40. If DC voltage only is applied to the charging roller 2 as the charging bias, a density of a toner image on the photoreceptor 40 may become uneven.

Therefore, one suggestion is to use an AC application method for the charging bias applied to the charging roller 2 from the power source 3. Generally, there are two AC application methods. In a first AC application method, a constant-voltage controlled DC voltage is overlapped with a constant-voltage controlled AC voltage. In a second AC application method, a constant-voltage controlled DC voltage is overlapped with a constant-current controlled AC voltage.

In an exemplary embodiment, the power source 3 employs an AC application method using a constant-voltage controlled DC voltage that is overlapped with an AC voltage whose peak-to-peak voltage is constant-voltage controlled. With this AC application method, the surface potential on the photoreceptor 40 after the charging process may be kept constant or substantially constant even if the gap G varies.

Figure 7:
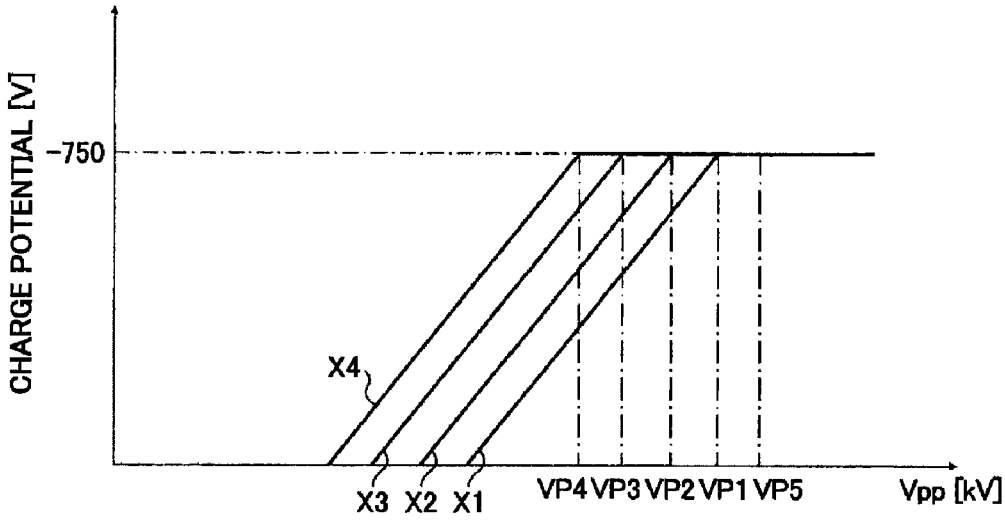
FIG. 7 illustrates a sample relation between a surface potential of a photoreceptor and an AC peak-to-peak voltage in an AC application method using a constant-voltage controlled AC voltage.

FIG. 7 illustrates a sample relation between the surface potential of the photoreceptor 40 and the AC peak-to-peak voltage Vpp. The charging bias applied to the core metal 5 of the charging roller 2 is a constant DC voltage of −750 V that is overlapped with an AC voltage whose peak-to-peak voltage Vpp is constant-voltage controlled. The surface of the photoreceptor 40 is charged by the charging device 60 (see FIG. 5).

Lines X1, X2, X3, and X4 show the relation when the gap G (see FIG. 5) is 80 μm, 60 μm, 40 μm, and 20 μm, respectively. The wavelength of the AC voltage is held constant.

As illustrated in FIG. 7, whichever size the gap G is, the surface potential of the photoreceptor 40 becomes substantially constant at a value equal or substantially equal to the value of the constant DC voltage applied to the charging roller 2 when the peak-to-peak voltage Vpp of the AC voltage is a certain value or greater. In FIG. 7, the value is −750 V. For example, when the gap G is 80 μm, the surface potential of the photoreceptor 40 becomes substantially constant at about −750 V with the voltage value of VP1 or greater. Similarly, when the gap G is 60 μm, 40 μm, and 20 μm, the surface potential of the photoreceptor 40 becomes substantially constant at about −750 V with the voltage value of VP2, VP3, and VP4 or greater, respectively.

Therefore, in the method using a constant-voltage controlled DC voltage that is overlapped with a constant-voltage control led AC voltage, a peak-to-peak voltage Vpp of an AC current required to charge the photoreceptor 40 to a substantially constant potential depends on the size of the gap G.

Further, the resistivity of the elastic layer 6 in the charging roller 2 varies depending on the environment, that is, the temperature and humidity, around the charging roller 2. In FIG. 7, the lines X1, X2, X3, and X4 shift to left in a high-temperature and high-humidity environment and shift to right in a low-temperature and low-humidity environment.

In this AC application method, a desirable AC voltage applied to the charging roller 2 may be an AC voltage whose peak-to-peak voltage is high enough to make the surface potential of the photoreceptor 40 substantially constant. For example, when an AC voltage whose peak-to-peak voltage is VP5 in FIG. 7 is applied to the charging roller 2, the surface potential of the photoreceptor 40 may be charged to a substantially constant potential regardless of the size of the gap G and/or change in the environment.

However, when the voltage value Vpp is excessively high, the photoreceptor 40 may be more easily degraded. For example, when the size of the gap G is 80 μm, which is the largest in FIG. 7, and an AC voltage whose peak-to-peak voltage is VP5 is applied to the charging roller 2, the charging roller 2 receives excessive voltages. This is more pronounced when the gap G between the charging roller 2 and the rotating photoreceptor 40 is smaller.

Therefore, an electric field formed between the charging roller 2 and the photoreceptor 40 becomes excessively strong, which accelerates the deterioration of the photoreceptor 40. Further, a toner film is more easily formed on the surface of the photoreceptor 40, which may cause image failure.

Therefore, it is desirable that the charging roller 2 receives a minimum peak-to-peak voltage of an AC voltage to charge the photoreceptor 40 to a constant value. However, when an AC voltage is constant-voltage controlled, the minimum peak-to-peak voltage of an AC voltage varies due to the changes in the gap size and/or the environment.

Figure 8:
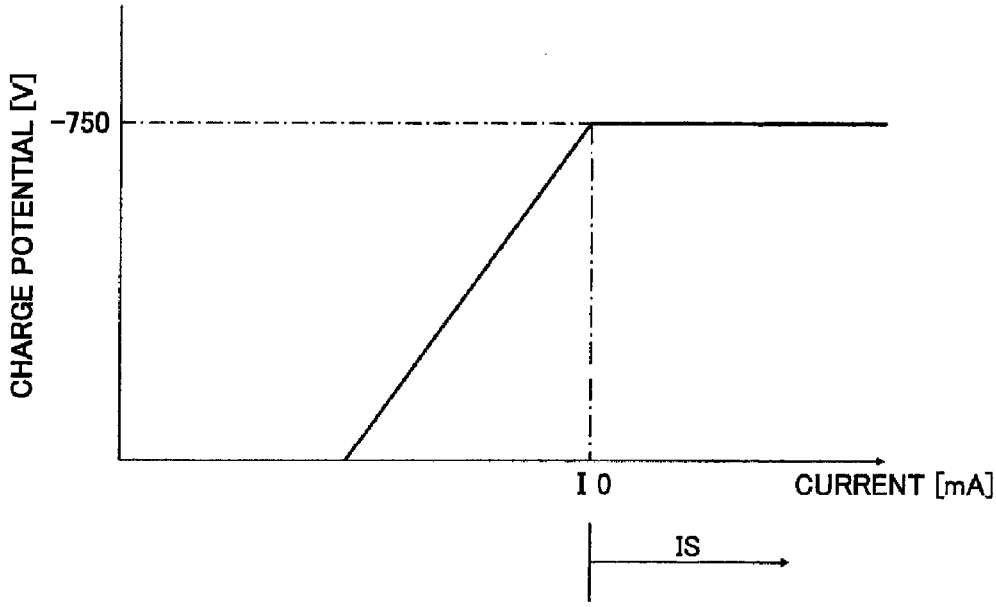
FIG. 8 illustrates a sample relation between a surface potential of a photoreceptor and an AC peak-to-peak voltage in an AC application method using a constant-current controlled AC voltage.

Referring to FIG. 8, comparative example 1, a relation between the charge potential on the surface of the photoreceptor 40 and a current applied to the charging roller 2 is described. In comparative example 1, a charge bias applied to the charging roller 2 is a constant-voltage controlled DC voltage that is overlapped with a constant-current controlled AC voltage. FIG. 8 illustrates the change in the charge potential on the photoreceptor 40 with respect to the currents applied to the charging roller 2 when the gap G between the charging roller 2 and the photoreceptor 40 is set to 80 μm, 60 μm, and 40 μm.

The wavelength of the AC voltage is constant. In FIG. 8, a horizontal axis shows current values (actual values) in which current of a DC component is not included. Because the current values of the DC component is very low compared to the current values of the AC component, a relation between the charge potential on the surface of the photoreceptor 40 and the current values including the AC component and the DC component is similar to the relation illustrated in FIG. 8. In this application, "current" and "current value" refer to the AC currents applied to the charging roller 2 and the value (actual value) of the AC currents, unless otherwise noted.

Regardless of the size of the gap G, the relation between the charge potential on the surface of the photoreceptor 40 and the current applied to the charging roller 2 is substantially constant. The charge potential on the photoreceptor 40 becomes substantially constant at a certain current value of I0 mA or greater in FIG. 8. At the current value of I0 mA or greater, the charge potential is substantially equal to the DC voltages (−750 V) applied to the charging roller 2. The current value not less than I0 mA is referred to as a saturated current value IS.

The charge potential is held substantially constant when the current value is I0 mA or greater, regardless of the DC voltage value, including 0 V. Even when the environment around the charging roller 2 changes, the charge potential is held substantially constant as described above.

In the above-described method, the peak-to-peak voltage of the AC voltage applied to the charging roller 2 is adjusted so that a constant current is applied to the charging roller 2 even if the gap G varies. For example, the surface potential of the photoreceptor 40 after the charging process may be held constant by setting the current value to the saturated current value IS (I0 mA or greater).

However, a power source generally requires a response time to output a voltage corresponding to the change in the gap G. Therefore, such a common power source fails to apply an AC voltage having a peak-to peak voltage that may supply a constant current corresponding to a size of the gap G at any given moment. Therefore, the surface potential of the photoreceptor 40 becomes excessively high if the voltage is insufficient and excessively low if the voltage is excessive.

Therefore, a constant-voltage controlled DC voltage is overlapped with a constant-voltage controlled AC voltage in the AC application method used in an exemplary embodiment, as described above. Further, the peak-to-peak voltage Vpp of the AC voltage is adjusted so that the surface of the photoreceptor 40 is charged to a constant or substantially constant value and toner filming is prevented or reduced.

The adjustment of the peak-to-peak voltage may be performed during a warm-up operation when the image forming apparatus 100 is turned on (power-on time). During the warm-up operation, an image quality adjustment may be performed after the adjustment of the peak-to-peak voltage. In the image quality adjustment, an exposure time, and a developing bias may be adjusted based on a pattern image. If the adjustment of the peak-to-peak voltage takes time, a warming-up time of the image forming apparatus 100 lengthens.

Further, the environment in the image forming apparatus 100 may change significantly from the power-on time due to heat generated in the fixer 25 (FIG. 2), etc., after repeated image forming. Accordingly, the AC peak-to-peak voltage adjusted at the power-on time may not match the environment, which results in image failure. Therefore, it is necessary to adjust the AC peak-to-peak voltage each time after a certain number of sheets pass through the image forming apparatus 100.

In an exemplary embodiment, because an adjusting method of the peak-to-peak voltage of an Ac voltage has the following features, the adjustment may be performed in a shorter time and in parallel with image forming. A first feature is that the peak-to-peak voltage Vpp of an AC voltage is adjusted to not less than twice a discharge start voltage Vth at which charging of the photoreceptor 40 starts. A second feature is that the AC peak-to-peak voltage Vpp is not adjusted to a target range in one adjustment operation, but is adjusted gradually multiple times.

If an AC voltage having a peak-to-peak voltage less than twice the charging start voltage Vth is applied during image forming, image failure (e.g., fog, toner scattering, etc.) may be caused. Therefore, a lower limit Vp of the AC peak-to-peak voltage Vpp is greater than twice the charging start voltage Vth.

Further, if the size of the gap G is different in the axial direction of the charging roller 2, the current is not sufficient in a part where the gap G is larger. Some of the toner on the photoreceptor 40 may not be transferred where the current is insufficient, resulting in image failure in which toner is partially absent in the form of white dots, a phenomenon that is referred to as white-dotted image. A limit voltage value at which the white-dotted image occurs is referred to as a white-dot limit WDL. The white-dot limit WDL is greater than twice the charging start voltage Vth. Therefore, the lower limit Vp of the AC peak-to-peak voltage Vpp may be greater than the white-dot limit WDL.

Figure 9:
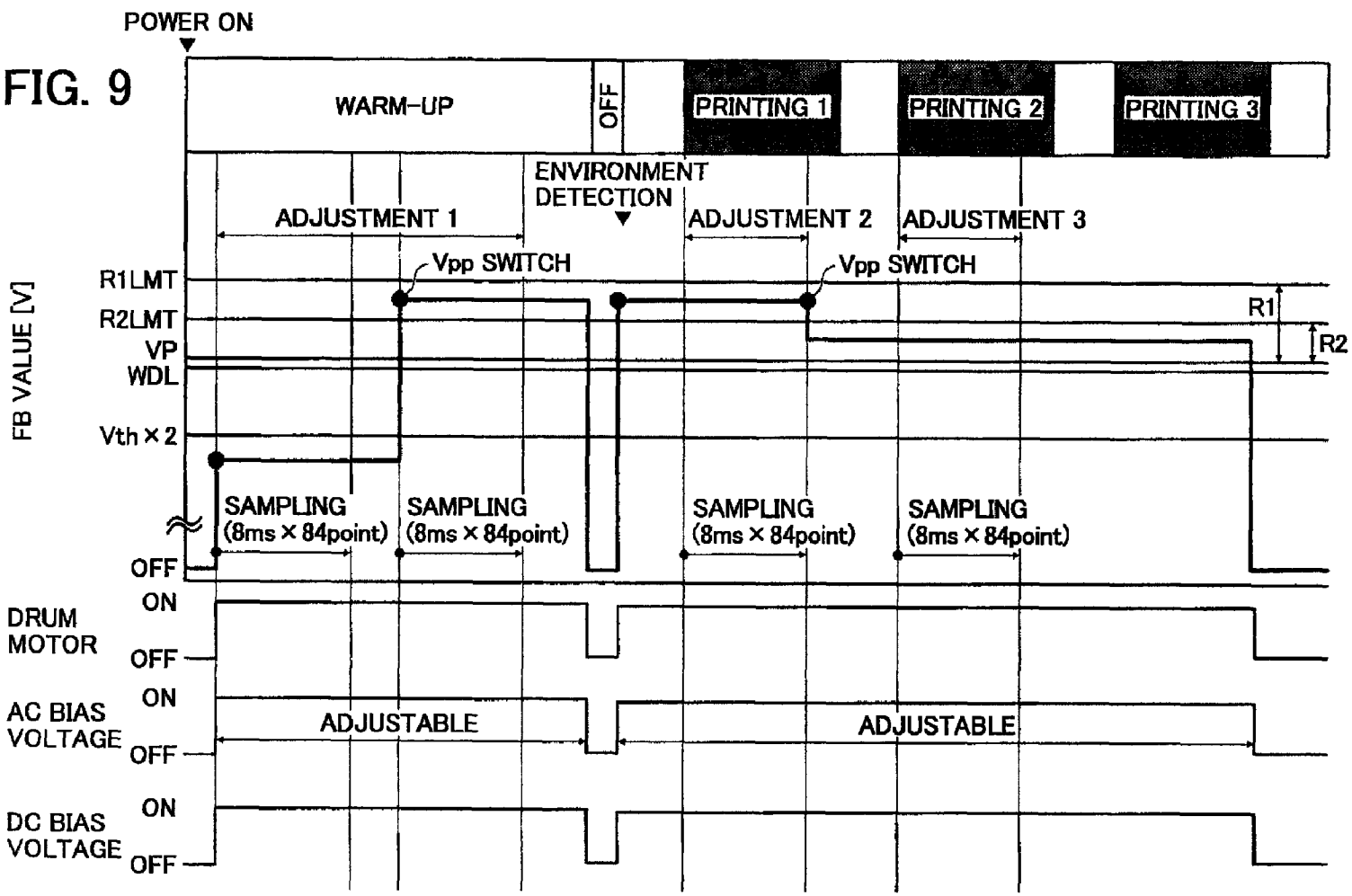
FIG. 9 is a sample timing chart of an adjustment of the AC voltage.
Figure 10A:
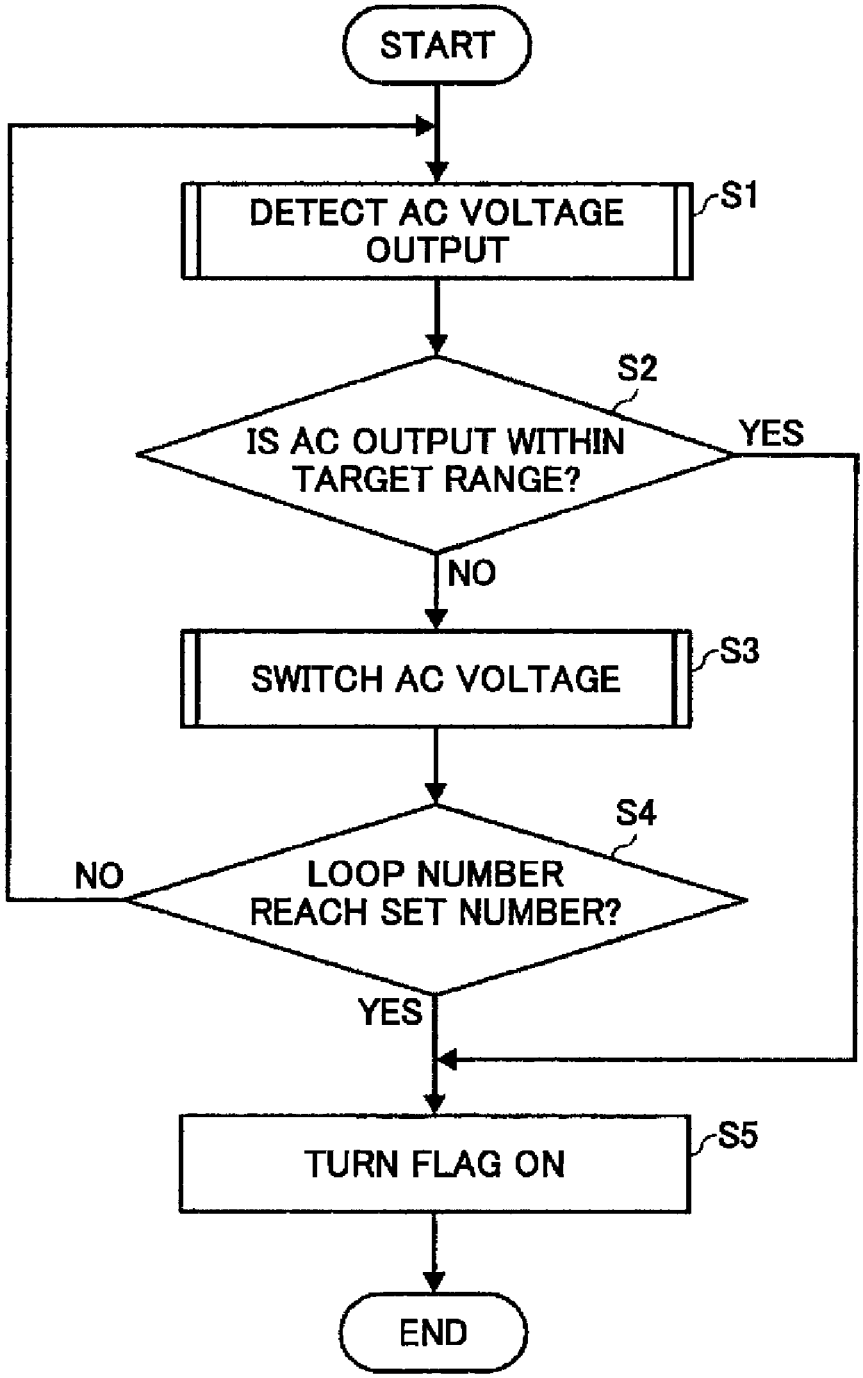
FIG. 10A is a flowchart of an initial adjustment of the AC voltage after a power-on time.
Figure 10B:
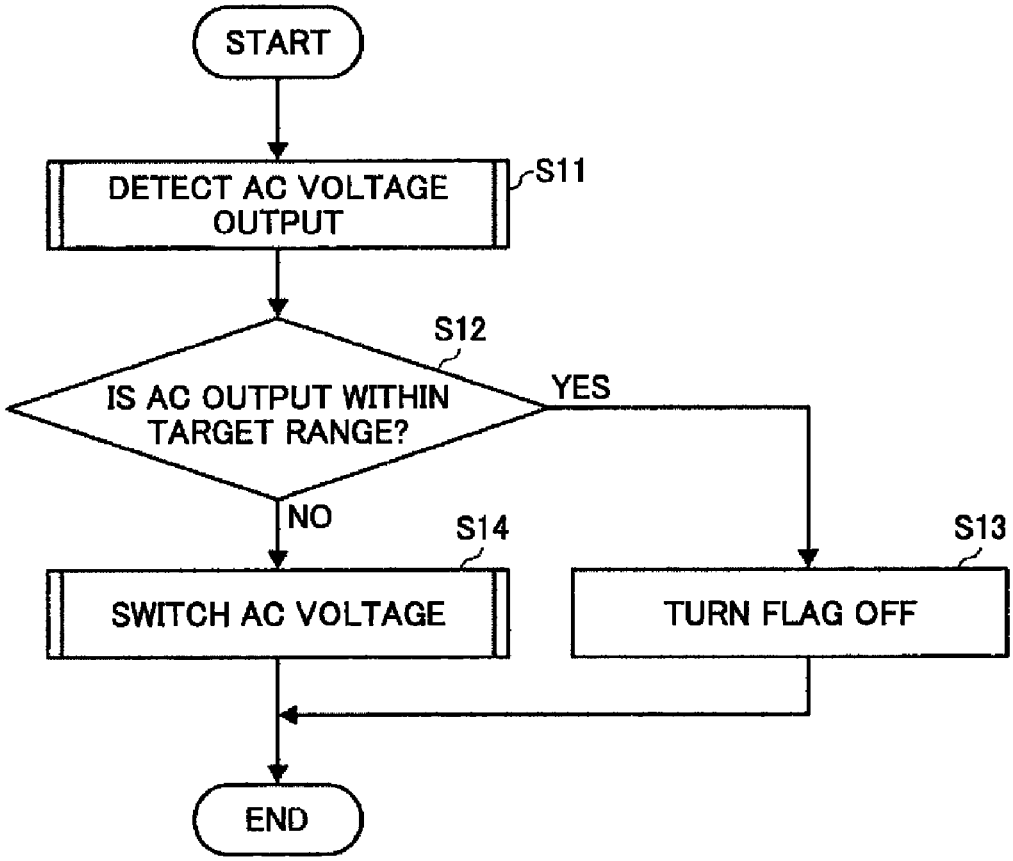
FIG. 10B is a flowchart of a subsequent adjustment of the AC voltage.

Referring to FIGS. 9, 10A, and 10B, adjustment of the AC peak-to-peak voltage Vpp is described below. FIG. 9 is a sample timing chart of the adjustments of the AC peak-to-peak voltage Vpp. FIG. 10A is a sample flowchart of an initial adjustment (gross adjustment). FIG. 10B is a sample flowchart of subsequent adjustments (fine adjustment) after the initial adjustment.

In FIG. 9, R1LMT represents an upper limit of a target range R1 in the initial adjustment (gross adjustment range), R2LMT represents an upper limit of a target range R2 in the subsequent adjustments (fine adjustment range). The higher the upper limit R1LMT, the lower the margin for toner filming.

The initial adjustment (first adjustment) may be performed during a warm-up time after the power-on time. When the image forming apparatus 100 is turned on, the drum motor to drive at least one of the photoreceptors 40 is turned on and an AC voltage and a DC voltage are applied to the charging roller 2, as illustrated in FIG. 9. An initial AC peak-to-peak voltage after the power-on time may be the same as or similar to a previous AC peak-to-peak voltage.

At S1 in FIG. 10A, an output value of the AC voltage is detected. For example, the FB value, which is the voltage value converted from the current value Icac supplied to the charging roller 2, is sampled. The current value Icac is determined by measuring the voltages applied at both ends of the micro resistance R in FIG. 6. The sampling is performed at 8-millisecond (ms) intervals for one rotation of the photoreceptor 40. In an exemplary embodiment, the FB value is sampled at 84 points (672/8) because the time for one rotation of the photoreceptor 40 is 672 ms. The controller 4 loads the 84 sample FB values and calculates a mean FB value as a detected FB value.

After the output value of the AC voltage (detected FB value) is detected, the controller 4 determines whether or not the detected FB value is within the target range R1 at S2.

For example, the target range R1 may be determined as follows: The controller 4 reads out an optimum alternating current value (target value) stored in the storage device 80 and converts the target current value into a voltage value as a target FB value with the micro resistance R. The target FB value may be used and stored as the target value of output value of the AC voltage, instead of or in addition to the optimum alternating current value.

Alternatively, the storage device 80 may store target values (e.g., target FB value or optimum AC value) in relation to environmental conditions (e.g., temperature and humidity) in a table like TABLE 1 below. Environment classes LL, ML, MM, MH, and HH may be determined based on the temperature and humidity. For example, the environment class LL is a lower temperature and lower humidity environmental condition. The controller 4 may read out the target value being related to the environmental condition detected by the environment detector 610 from the table 1. The target values may be determined for each of the environment classes for each of the image forming units 18K, 18M, 18C, and 18Y.

TABLE 1

| | K | M | C | Y |
|---|---|---|---|---|
| LL | 2.16 | 2.13 | 2.05 | 2.08 |
| ML | 2.14 | 2.11 | 2.02 | 2.06 |
| MM | 2.11 | 2.08 | 2 | 2.04 |
| MH | 2.09 | 2.06 | 1.97 | 2.01 |
| HH | 2.06 | 2.04 | 1.95 | 1.99 |

The controller 4 determines the target range R1 based on the target FB value. For example, a tolerance of the target FB value is about 0.04 V and the target range R1 is the target FB value +/− about 0.04 V and greater than the lower limit Vp.

The controller 4 calculates a difference (FB value difference) by deducting the detected FB value from the target FB value and determines whether or not the FB value difference is within the target range R1 (tolerance). When the FB value difference is within the tolerance (YES at S2), the controller 4 turns a flag on at S5. When the FB value difference is not within the target range R1 (NO at S2) as in FIG. 9, the controller 4 switches the AC voltage at S3.

An adjustment amount ΔVpp 1(kV) of the AC peak-to-peak voltage in the initial adjustment is calculated at S11 by the following formula 1:

$$\Delta Vpp1=\alpha 1\times(\text{target FB value}-\text{detected FB value})$$

wherein α1 is a gross adjustment coefficient.

The greater the gross adjustment coefficient α1, the greater the peak-to-peak voltage adjustment amount ΔVpp1 to the FB value difference. In an exemplary embodiment, the gross adjustment coefficient α1 is about 500. A subsequent AC peak-to-peak voltage is calculated by the following formula 2:

$$Vpp1(\text{kV})=Vpp0+\Delta Vpp1$$

wherein Vpp0 is a current AC peak-to-peak voltage and Vpp1 is a calculated subsequent AC peak-to-peak voltage.

The controller 4 then determines whether or not the calculated subsequent AC peak-to-peak voltage Vpp1 is less than the lower limit Vp.

Because the charging start voltage Vth varies according to the size of the gap G as illustrated in FIG. 7, for example, the lower limit Vp is set to Vp3 or greater when the gap is X3 (40 μm). The lower limit Vp may be preliminarily obtained through experimentation and stored in the storage device 80. When the calculated subsequent AC peak-to-peak voltage Vpp1 is less than the lower limit Vp, the lower limit Vp is used as the subsequent AC peak-to-peak voltage. When the calculated subsequent peak-to-peak voltage Vpp1 is not less than the lower limit Vp, the calculated subsequent peak-to-peak voltage Vpp1 is used as the subsequent peak-to-peak voltage.

The controller 4 stores the next AC peak-to-peak voltage in the storage device 80 and switches the AC peak-to-peak voltage to the next AC peak-to-peak voltage.

After the AC peak-to-peak voltage Vpp is adjusted, the controller 4 checks whether or not a loop count reaches a set number, which is an integer, at S4. In an exemplary embodiment, the loop number is set to 2. When the loop number is less than the set number, the controller 4 increments the loop number and returns to S1 and repeats the procedure. When the loop number reaches the set number, the controller 4 turns the flag on at S5 and completes the procedure.

The gross adjustment coefficient α1 and the target range R1 may be set so that the peak-to-peak voltage Vpp may enter the target range R1 in one switching.

Referring to FIGS. 9 and 10B, a procedure of the subsequent adjustments (fine adjustment) of the AC peak-to-peak voltage Vpp is described below.

A second adjustment (fine adjustment) of the AC peak-to-peak voltage Vpp is performed during a first printing operation. For example, the controller 4 checks whether or not the flag is on when the printing command arrives. The controller 4 starts the second adjustment when the flag is on.

The fine adjustments of the AC peak-to-peak voltage Vpp may be performed in parallel with image forming (printing operation).

Because the lower limit Vp is greater than twice the charging start voltage Vth and the white-dot limit WDL as described above, image failure may not be caused even if the adjustment of the AC peak-to-peak voltage is performed in parallel with image forming.

At S11, an output value of the AC voltage is detected simultaneously when a first printing operation is started. The sampling of the FB values is performed for one rotation of the photoreceptor 40 (e.g., 84 points). The controller 4 calculates a mean FB value as a detected FB value.

The controller 4 calculates a FB value difference by deducting the detected FB value from the target FB value and determines whether or not the FB value difference is within a tolerance of the target FB value (target range R2) at S12. For example, the tolerance is about 0.02 V, and the target range R2 is the target FB value +/− about 0.02 V and not less than the lower limit Vp.

When the detected FB value is within the target range R2 (YES at S12), the controller 4 turns the flag off at S13 and completes the adjustment. When the difference is not within the target range R2 (NO at S12) as in FIG. 9, the controller 4 switches the AC peak-to-peak voltage at S14.

An AC peak-to-peak voltage adjustment amount ΔVpp2 (kV) in the subsequent adjustments (fine adjustment) is calculated by the following formula 3:

$$\Delta Vpp2=\alpha 2\times(\text{target FB value}-\text{detected FB value})$$

wherein α2 is a fine adjustment coefficient.

The fine adjustment coefficient α2 may be smaller than the gross adjustment coefficient α1. If the FB value differences in the rough and fine adjustments are equal, the AC peak-to-peak voltage adjustment amount ΔVpp2 in the subsequent adjustment is smaller than the adjustment amount ΔVpp1 in the initial adjustment. In an exemplary embodiment, the fine adjustment coefficient ΔVpp2 is about 200.

A subsequent AC peak-to-peak voltage (kV) is calculated by formula 2. The controller 4 determines whether or not the calculated AC subsequent peak-to-peak voltage Vpp2 is less than the lower limit Vp. The controller 4 switches the AC peak-to-peak voltage Vpp to the lower limit Vp when the calculated subsequent AC peak-to-peak voltage Vpp2 is less than the lower limit Vp, or to the calculated subsequent AC peak-to-peak voltage Vpp2 when the calculated subsequent AC peak-to-peak voltage Vpp2 is not less than the lower limit Vp. After the AC peak-to-peak voltage Vpp is adjusted at S14, the controller 4 completes the second adjustment.

The controller 4 checks whether or not the flag is on when a subsequent printing command arrives. When the flag is off, that is, the detected FB value is within the target range R2, the controller 4 does not adjust the AC peak-to-peak voltage Vpp during a second printing operation.

On the contrary, when the peak-to-peak voltage Vpp is changed in the second adjustment as in FIG. 9, the flag is on. Therefore, a third adjustment is performed during the second printing operation. The third adjustment may be performed similarly to the operations in the second adjustment. Alternatively, different operations may be performed in the third adjustment. In the third adjustment, when the FB value difference is within the tolerance, the controller 4 turns the flag off. As a result, the adjustment of the AC peak-to-peak voltage Vpp is not performed during a subsequent printing operation (third printing operation).

Figure 11:
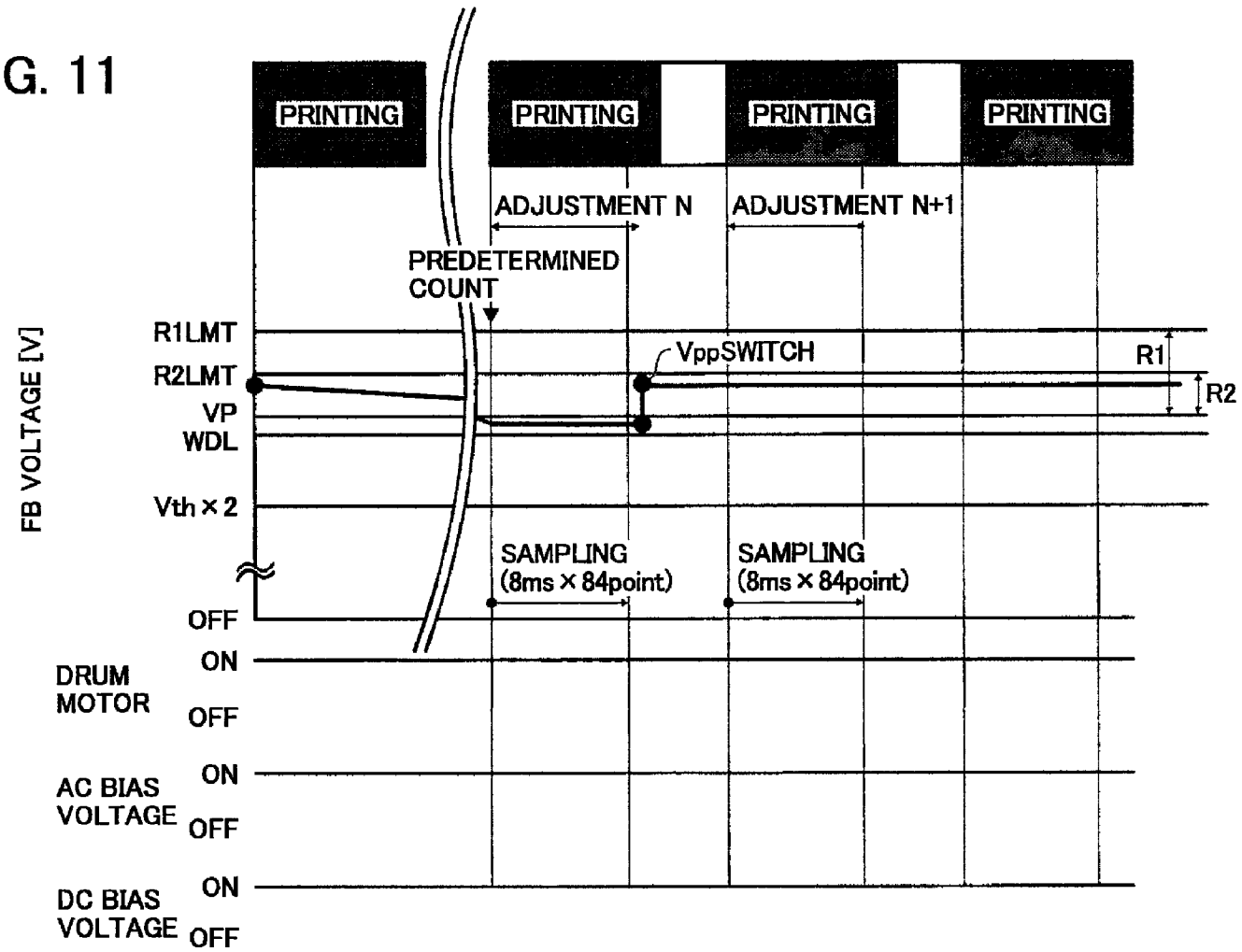
FIG. 11 is a timing chart of an adjustment of the AC voltage performed at intervals of printing a predetermined number of sheets after the AC voltage enters a target range.

It may be unnecessary to adjust the AC peak-to-peak voltage Vpp for each printing operation after the AC peak-to-peak voltage Vpp enters the target range, as described above. For example, the adjustment may be performed each time after a predetermined or desirable number of sheets (e.g., 30 sheets) pass through the image forming apparatus 100 as illustrated in FIG. 11.

The AC voltage may be better controlled by setting the intervals of subsequent adjustments shorter when the detected FB value is out of the target value than when the detected FB value enters the target range. The AC peak-to-peak voltage may better match the environment by determining the intervals of subsequent adjustments based on a degree of change in the environment after the detected FB value enters the target range. Further, AC voltage may be brought within the target range more quickly by adjusting the AC peak-to-peak voltage for each printing operation when the detected FB value is out of the target range.

Alternatively, in a case of printing a large number of sheets in a printing job, the adjustment may be started when a predetermined or desirable number of sheets are printed midway through the job.

For example, the controller 4 may count the number of sheets passing through the image forming apparatus 100. The controller 4 may turn the flag on when a count value reaches the predetermined or desirable number (e.g., 30). The controller 4 checks whether or not the flag is on when the printing operation is started, as described above. Therefore, the controller 4 may start the adjustment of the AC peak-to-peak voltage each time after the predetermined or desirable number of sheets pass through the image forming apparatus 100 after the AC peak-to-peak voltage enters the target range. The controller 4 may perform operations similar to the operations in the second adjustment.

Figure 12:
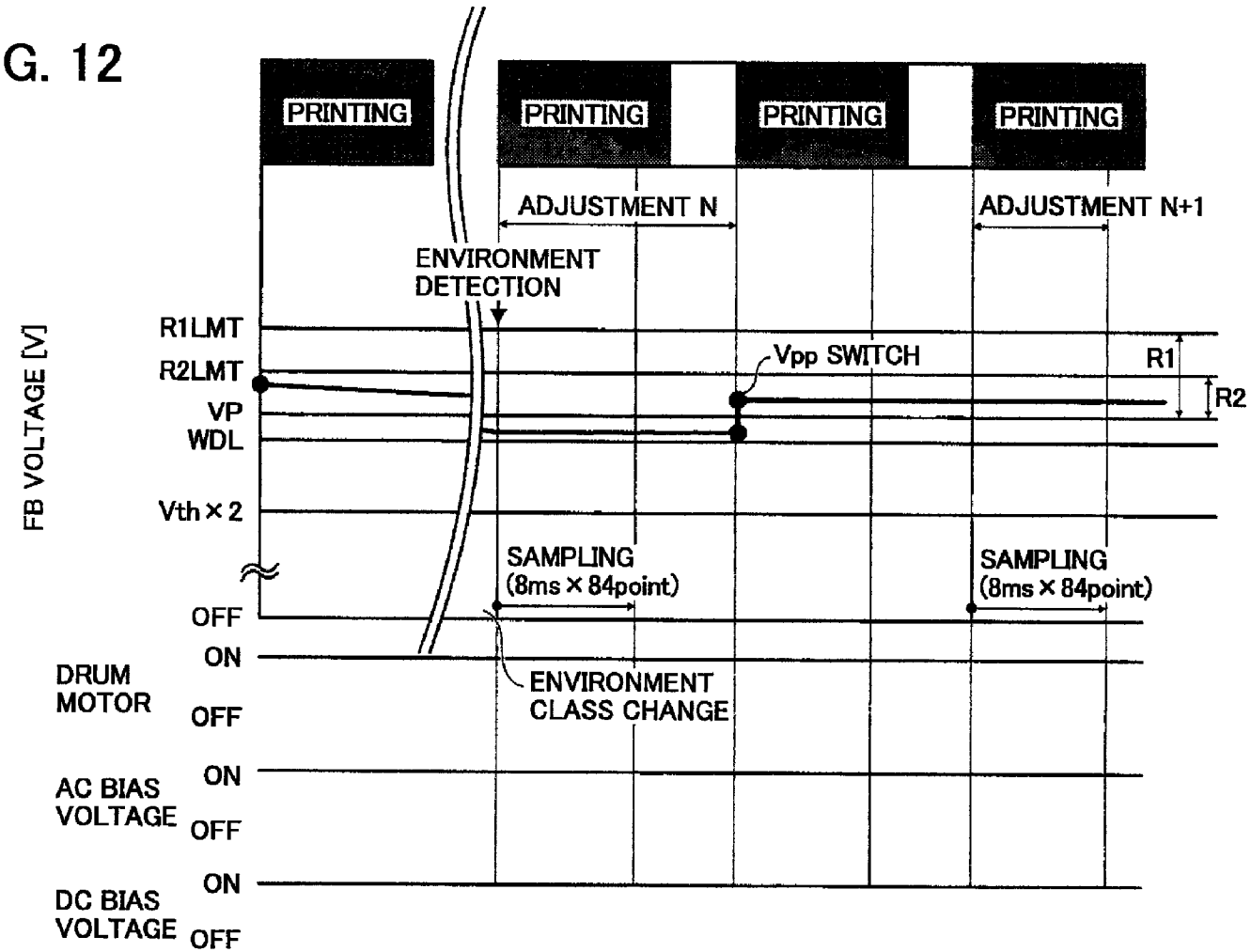
FIG. 12 is a timing chart of an adjustment of the AC voltage performed each time an environmental condition changes to some extent after the AC voltage enters the target range.

Alternatively, as illustrated in FIG. 12, the environment detector may be configured to detect the environment in the image forming units 18K, 18M, 18C, and 18Y at predetermined or desirable intervals. When the environment changes to some extent from an environment in a previous AC peak-to-peak voltage adjustment, for example, when the environment class shown in table 1 changes, the controller 4 may turn the flag on and perform the adjustment. As a result, sampling of the FB value is started.

Figure 13:
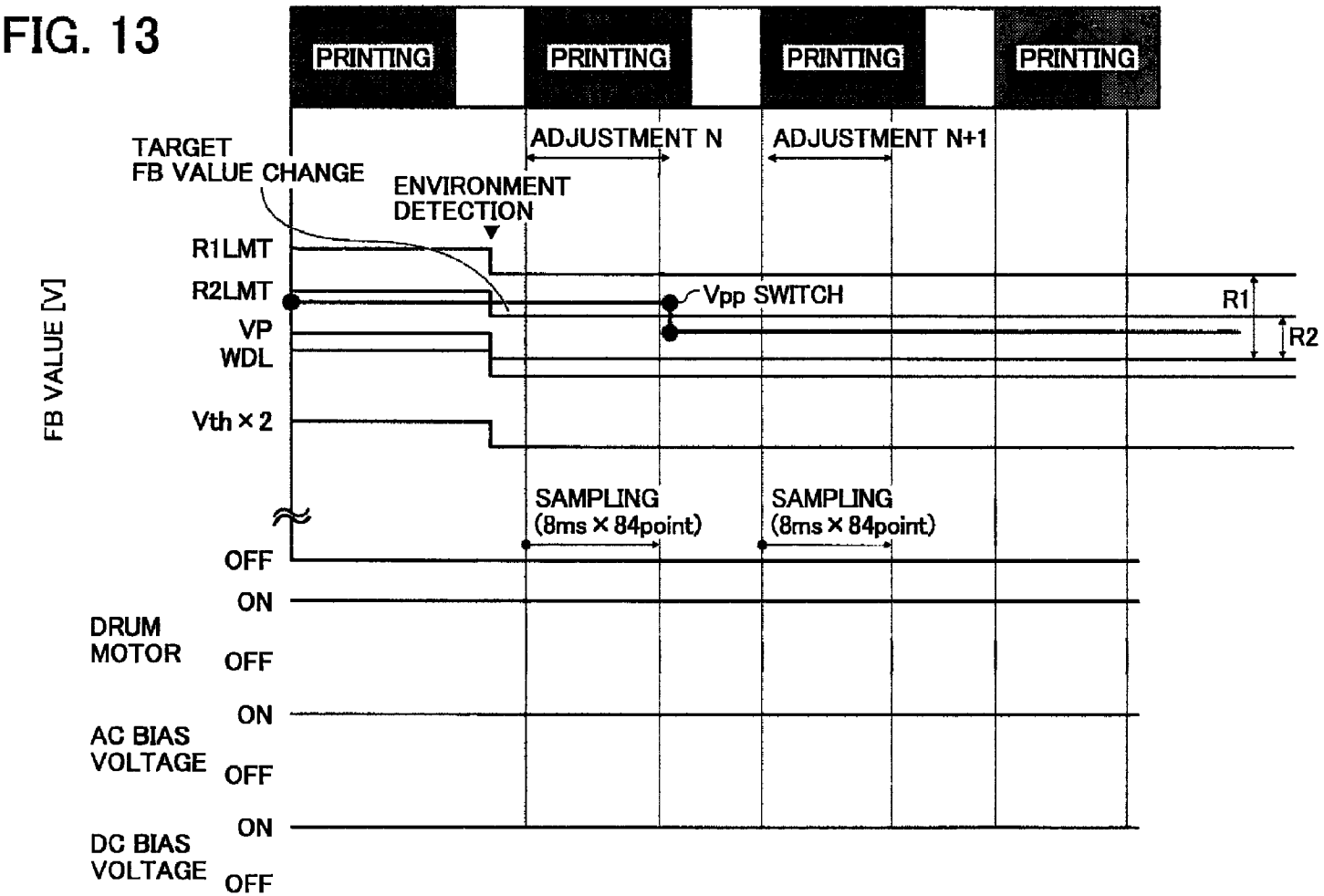
FIG. 13 is a timing chart of an adjustment of the AC voltage performed each time when a target value is changed after the AC voltage enters in a target range.

Further, the controller 4 may change the target FB value (lower limit) based on the optimum AC voltages in table 1 as illustrated in FIG. 13, when the environment changes to some extent or the environment class changes. The controller 4 may adjust the AC peak-to-peak voltage based on the changed target FB value.

Alternatively, the AC peak-to-peak adjustment may be performed for each printing operation, regardless of whether the FB value difference is within the tolerance.

Figure 14:
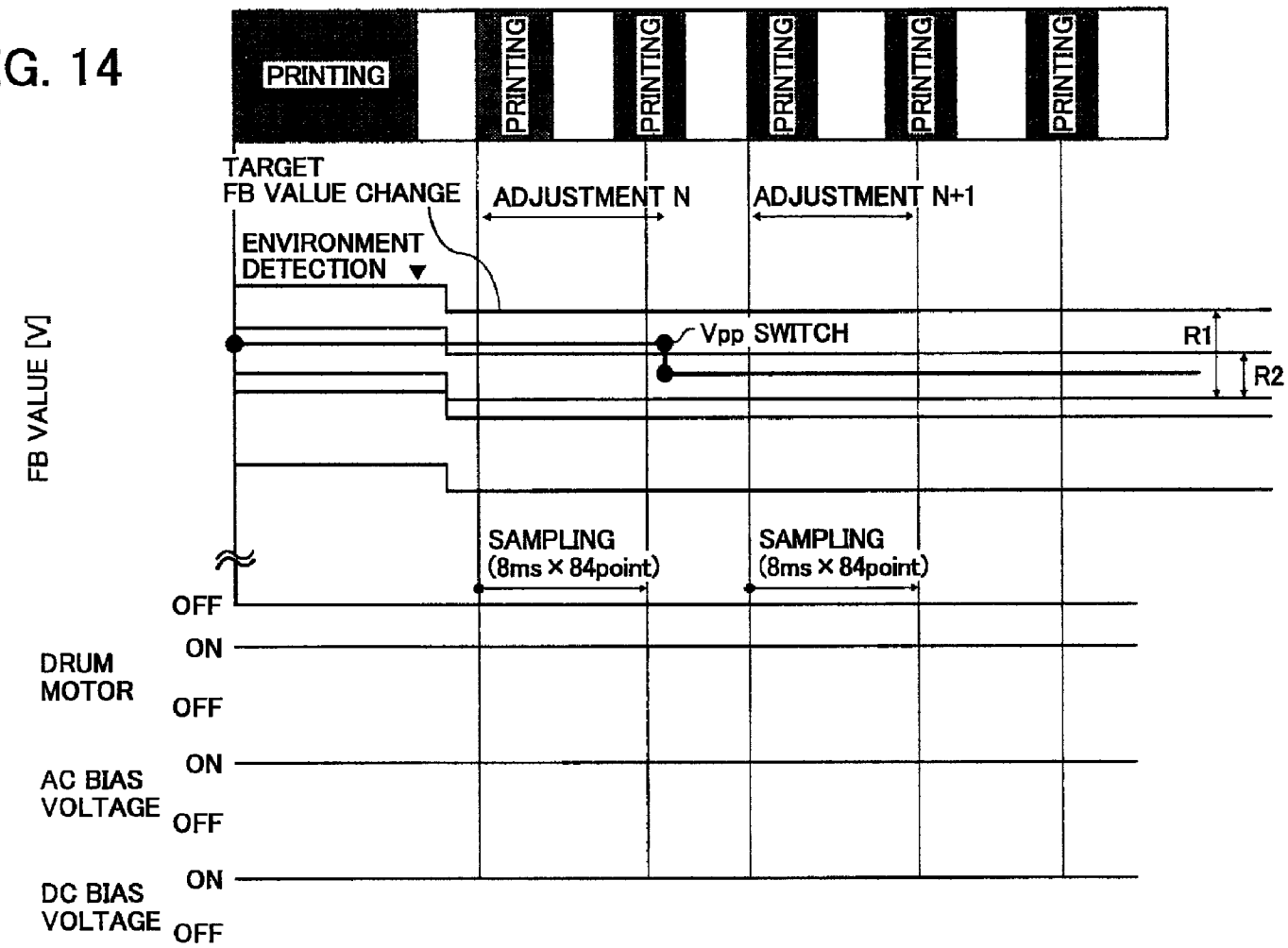
FIG. 14 is a timing chart of an adjustment of the AC voltage when a printing operation takes less time.

Further, in a case of a sheet having a smaller size in a sheet transport direction, a printing operation may be completed before the FB values are sampled for a rotation of the photoreceptor 40. Therefore, the controller 4 may continue the sampling after the printing operation is completed as illustrated in FIG. 14. When a subsequent printing command arrives during the sampling, the next printing operation is performed regardless of whether the sampling is completed.

In an exemplary embodiment, the AC peak-to-peak voltage Vpp is adjusted to twice the charging start voltage Vth or greater and the adjustment may be performed in parallel with image forming (printing operation), as described above. Therefore, productivity may not decrease even if the adjustment is performed at shorter intervals, for example, each time after about 30 sheets are printed.

Figure 15:
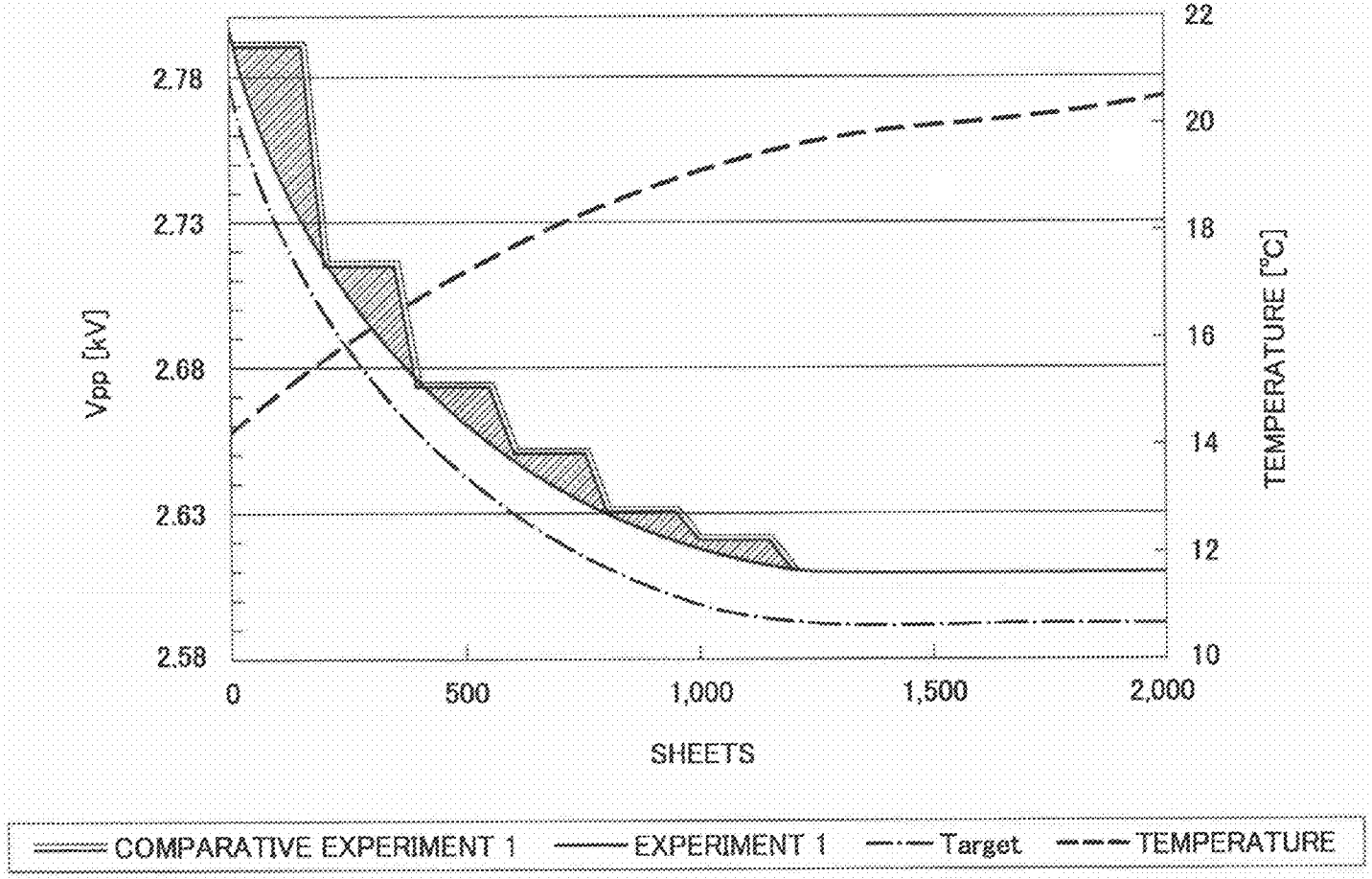
FIG. 15 is a graph illustrating relations between the AC peak-to-peak voltage and an number of sheets printed according to an exemplary embodiment and a comparative experiment.

Referring to FIG. 15, a relation between the AC peak-to-peak voltage and the number of sheets printed is described below. Experiment 1 according to an exemplary embodiment and comparative experiment 1 were performed to study the relation. In both experiments, 2,000 sheets were printed at a temperature of 10° C. and a relative humidity of 15% (LL environment class). In experiment 1, the AC peak-to-peak voltage was adjusted each time after 30 sheets were printed. In comparative experiment 1, the AC peak-to-peak voltage was adjusted each time after 200 sheets were printed.

As illustrated in FIG. 15, a stepwise change of the AC peak-to-peak voltage was observed in comparative experiment 1. In experiment 1, the AC peak-to-peak voltage was lower and changed more smoothly compared with the comparative experiment 1. The difference in the AC peak-to-peak voltage between experiment 1 and comparative experiment 1 is shown with hatching.

Therefore, the AC peak-to-peak voltage may better match the environment and the margin for toner filming may be increased by adjusting the AC peak-to-peak voltage at shorter intervals. After 2,000 sheets were printed, although no toner filming was observed on the surface of the photoreceptor 40 in experiment 1, some toner filming was observed on the surface of the photoreceptor 40 in comparative experiment 1.

Further, in an exemplary embodiment, the gross adjustment coefficient $\alpha 1$ in the initial adjustment is larger than the fine adjustment coefficient $\alpha 2$ in the subsequent adjustments so that the target range is larger in the initial adjustment than in the subsequent adjustments. The environment in the initial adjustment after the power-on time may differ significantly from the environment in a previous adjustment. Accordingly, the AC peak-to-peak voltage is likely significantly different from the target value. Yet even when the AC peak-to-peak voltage is significantly different from the target value, the AC peak-to-peak voltage may come within the target range more quickly in the gross adjustment than in the fine adjustment because the adjustment amount is larger.

Further, the adjustment amount in the fine adjustment is smaller than in the gross adjustment because the AC peak-to-peak voltage is brought close to the target value in the gross adjustment. Therefore, the AC peak-to-peak voltage may be brought close to the target value more quickly by using the fine adjustment coefficient $\alpha 2$.

Figure 16:
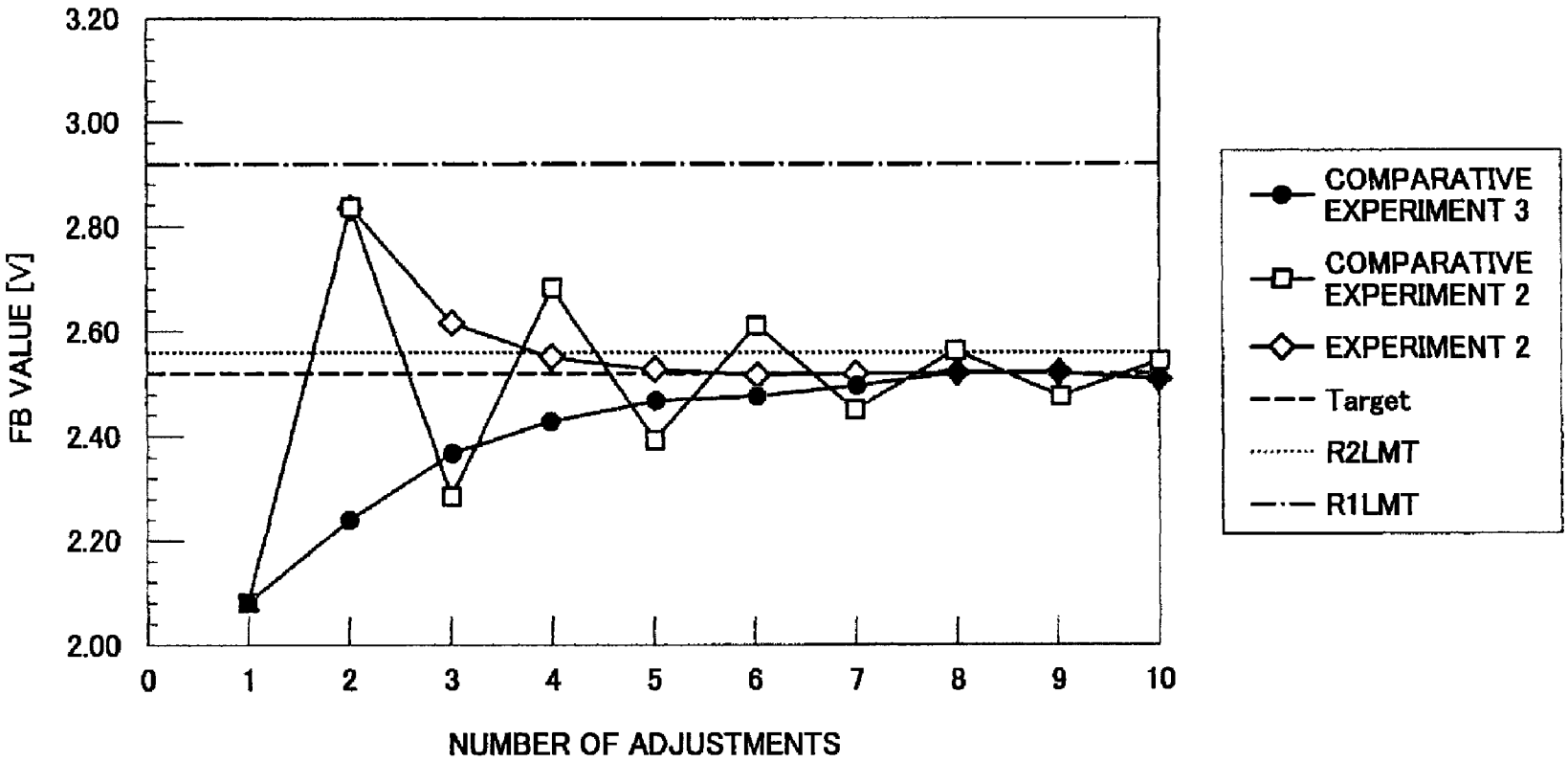
FIG. 16 is a graph illustrating relations between required number of adjustments and adjustment coefficients.

FIG. 16 illustrates results of experiment 2 according to an exemplary embodiment and comparative experiments 2 and 3. In experiment 2, the AC peak-to-peak voltage was adjusted by using both of the gross adjustment coefficient $\alpha 1$ and the fine adjustment coefficient $\alpha 2$. The AC peak-to-peak voltage was adjusted by using only the gross adjustment coefficient $\alpha 1$ in comparative experiment 2 and by using only the fine adjustment coefficient $\alpha 2$ in comparative experiment 3.

In comparative experiment 2, the AC peak-to-peak voltage entered in the fine adjustment range R2 (target value+0.02 V) in a tenth adjustment, as illustrated in FIG. 16. In comparative adjustment 3, the AC peak-to-peak voltage entered in the fine adjustment range R2 in a ninth adjustment.

In experiment 2, in which an initial adjustment was performed with the gross adjustment coefficient $\alpha 1$ and subsequent adjustments were performed with the fine adjustment coefficient $\alpha 2$, the AC peak-to-peak voltage entered the fine adjustment range R2 in a third adjustment.

When the detected FB value is greater than the target value (lower limit Vp), the AC peak-to-peak voltage may become less than white-dot limit WDL if adjusted with the gross adjustment coefficient $\alpha 1$. Therefore, when the target FB value minus the detected FB value is negative, the fine adjustment coefficient $\alpha 2$ may be used in the adjustment to prevent the AC peak-to-peak voltage from falling below the lower limit Vp.

Figure 17:
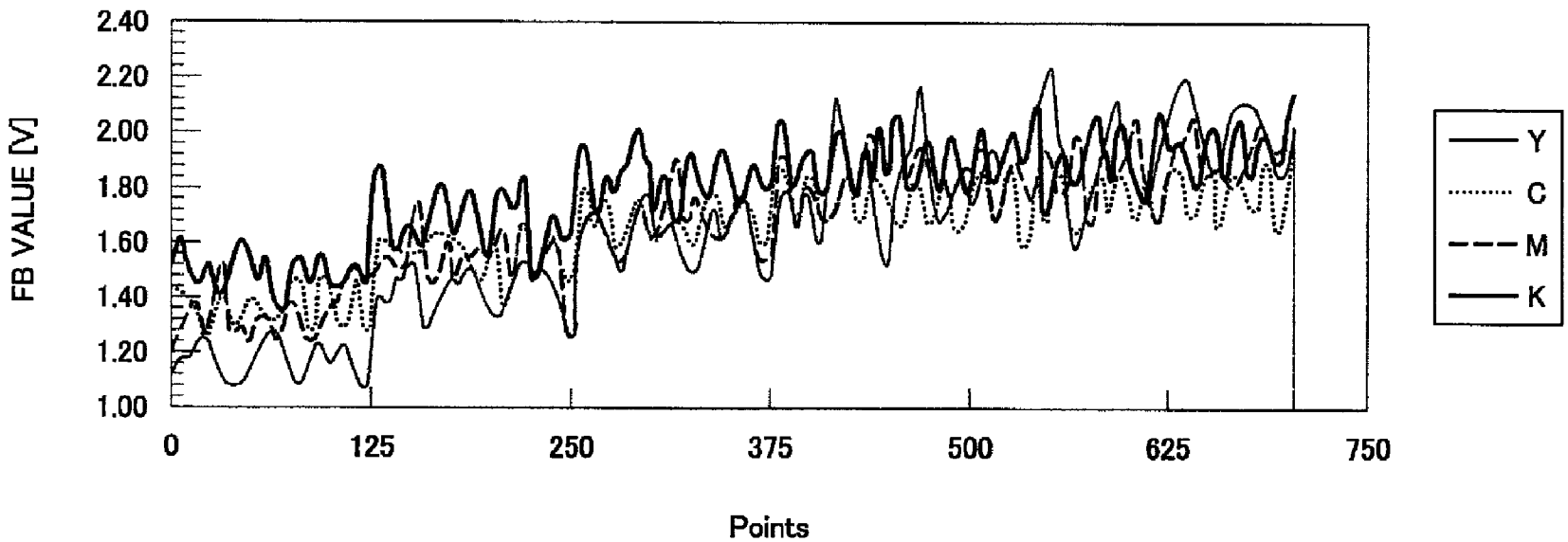
FIG. 17 is a graph illustrating changes in feed back (FB) values.

FIG. 17 illustrates a sample change in the FB value. To study the change, the FB value was sampled at 8-millisecond intervals and the AC peak-to-peak voltage was adjusted at intervals of 125 points. As illustrated in FIG. 17, the FB value ranged from about 0.4 V to 0.6 V due to the change of the gap G between the photoreceptor 40 and the charging roller 2, etc. Therefore, image failures may be prevented or reduced even when the target range R1 is as large as about 0.04 V, which is about one tenth of the above-described variation range. Therefore, the target range R1 in the gross adjustment may be as large as about 0.04 V in an exemplary embodiment to adjust the AC peak-to-peak voltage to within the target range in one adjustment.

Further, the tolerance of the target value in the first and subsequent adjustments may be determined according to a variation characteristic of the FB value, etc. The adjustment amount of the AC peak-to-peak voltage to the FB value difference may be determined according to a condition of electric hardware of the image forming apparatus 100.

Although the AC peak-to-peak voltage is switched immediately after the subsequent peak-to-peak voltage is calculated in an exemplary embodiment, a timing of the switching is not limited to the above. The start of a subsequent printing operation may be a trigger to switch the AC peak-to-peak voltage.

Further, a timing of the start of the subsequent adjustment is not limited to the start of a printing operation as in an exemplary embodiment. The subsequent adjustment may be started asynchronously with the printing operation. When a printing command arrives during the subsequent adjustment, the controller 4 may start a printing operation without waiting for completion of the subsequent adjustment. Even when the printing operation is started before the subsequent adjustment is completed, image failure may be prevented or reduced because the AC peak-to-peak voltage applied to the charging roller 2 during the subsequent adjustment is greater than twice the charging start voltage Vth.

An exemplary embodiment is described below, referring to a sample timing chart of FIG. 18 and sample flowcharts of FIGS. 19A and 19B.

Figure 18:
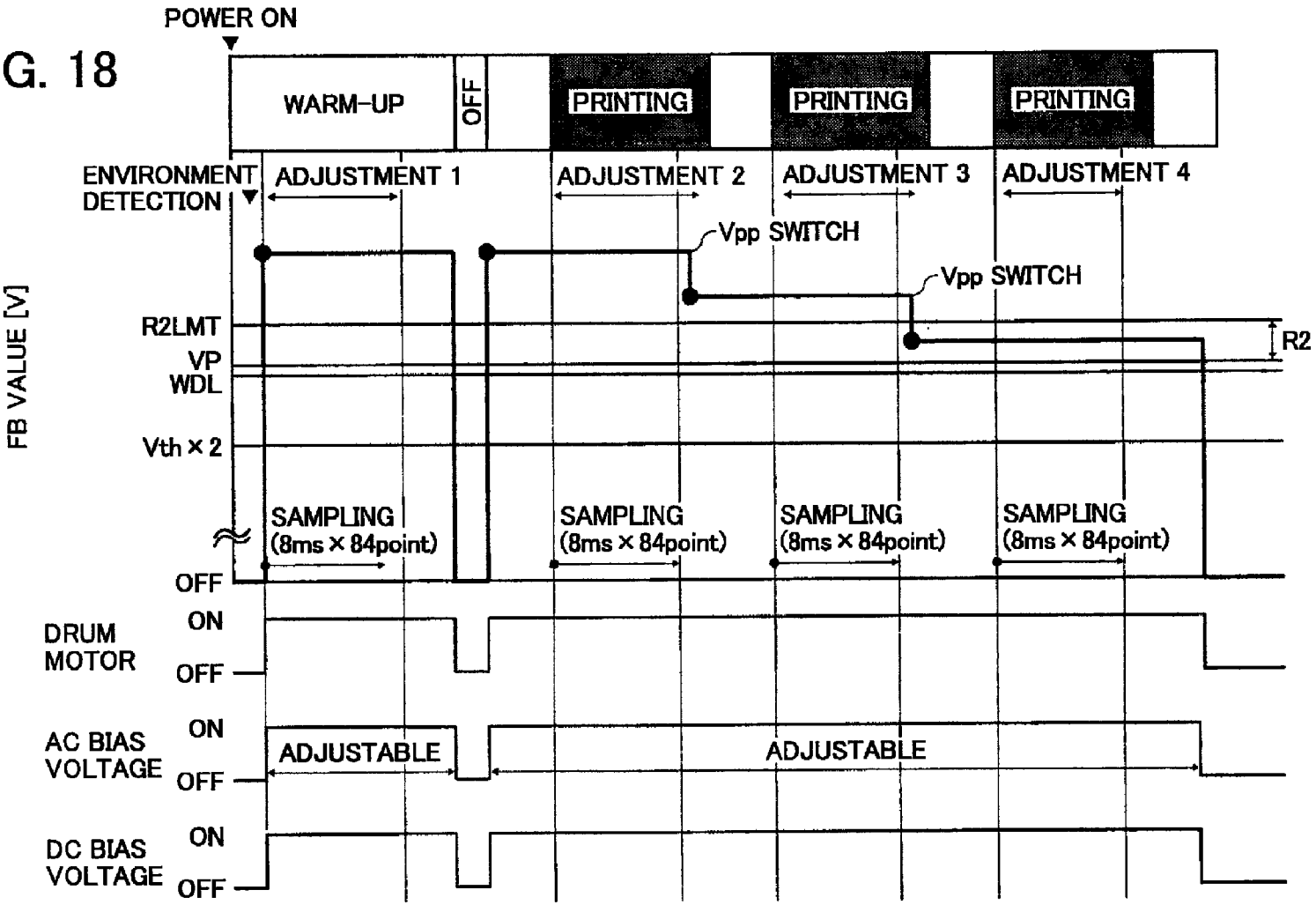
FIG. 18 is a timing chart of an adjustment of the AC voltage according to an exemplary embodiment.

As illustrated in FIG. 18, the environment detector detects an environmental condition in the image forming apparatus 100 after the image forming apparatus 100 is turned on. The controller 4 determines an AC peak-to-peak voltage Vpp based on results of the environment detection.

For example, the environmental condition and AC peak-to-peak voltage values are stored in relation to each other in a table that is preliminarily stored in the storage device 80. An initial AC peak-to-peak voltage to be applied to the charging roller 2 after the power-on time may be determined based the results of the environment detection and the table. The AC peak-to-peak voltage values in the table may be greater than the lower limit Vp to prevent white-dot images.

The environmental condition may be temperature, relative humidity, absolute humidity, or a combination thereof. The gap G may vary due to wear of components in addition to changes in temperature and/or humidity around the charging roller 2. Therefore, the image forming apparatus 100 may include a gap detector to detect the variation of the gap G.

After the initial peak-to-peak voltage is determined, a gross adjustment of the AC peak-to-peak voltage is started. For example, the drum motor to drive at least one of the photoreceptors 40 is turned on. A DC voltage and an AC voltage having the peak-to-peak voltage determined as above are applied to the charging roller 2.

Figure 19A:
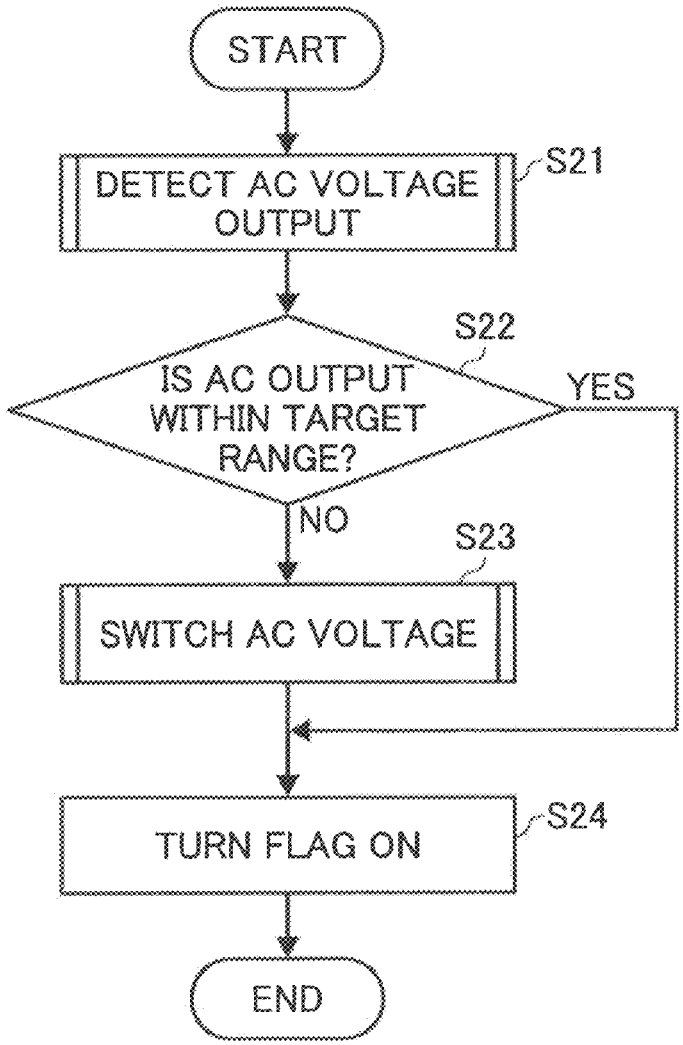
FIG. 19A is a flowchart of an initial adjustment of the Ac voltage after a power-on time.
Figure 19B:
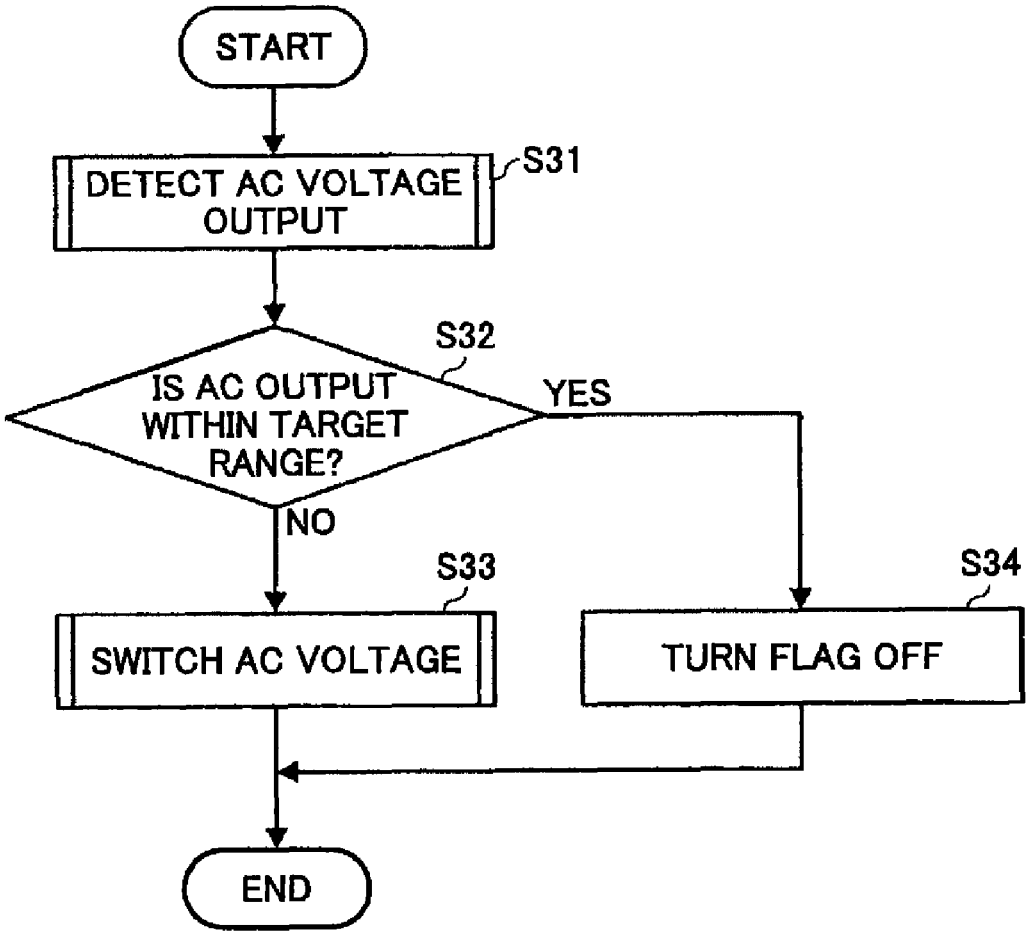
FIG. 19B is a flowchart of a subsequent adjustment of the AC voltage.

At S21 in FIG. 19A, the controller 4 detects an output value of the AC voltage. The controller 4 samples FB values for one rotation of the photoreceptor 40 (84 points) and calculates a detected FB value. The controller 4 calculates a target FB value based on the results of the environment detection and the table.

At S22, the controller 4 determines whether or not the detected FB value is within a target range and whether to switch the AC peak-to-peak voltage. In an exemplary embodiment, the target range is the target FB value or greater. When the detected FB value is greater than the target FB value, the detected FB value is within the target range.

When the detected FB value is within the target range (YES at S22), the controller 4 turns a flag on without switching the AC peak-to-peak voltage at S24 and completes the gross adjustment. When the detected FB value is less than the target FB value (NO at S22), the controller 4 calculates an adjustment amount of the AC peak-to-peak voltage with the gross adjustment coefficient $\alpha 1$ and then calculates a subsequent peak-to-peak voltage. The controller 4 switches the AC peak-to-peak voltage at S23 and turns the flag on at S24. The controller 4 completes the gross adjustment.

As described above, a loop processing is not performed in the gross adjustment in an exemplary embodiment. Therefore, the gross adjustment may be completed in a shorter time and the warm-up time may be reduced.

The fine adjustment of the AC peak-to-peak voltage may be performed multiple times, in order to adjust the AC peak-to-peak voltage to within a target range of the fine adjustment. The target range of the fine adjustment may be not greater than the target value plus about 0.02 V, for example.

In an exemplary embodiment, the AC peak-to-peak voltage is adjusted in a range greater than twice the charging start voltage even in the gross adjustment. Therefore, the adjustment of the AC peak-to-peak voltage may be performed in parallel with an adjusting operation including image forming. For example, an image quality adjustment (e.g., density adjustment) or a positional adjustment (color displacement adjustment) may be performed in parallel with the adjustment of the AC peak-to-peak voltage.

In an exemplary embodiment, the adjustment of the AC peak-to-peak voltage includes a sequence of detecting an output value (FB value) of the AC voltage, determining whether or not the output value is within the target range, and switching the AC voltage when the output value is not within the target range. The sequence is not repeated in an adjustment, but is performed in separate adjustments until the detected output value enters the target range. Therefore, the adjustment may be completed in a shorter time, enabling various operations to be performed after the adjustment of the AC peak-to-peak voltage to be started earlier.

Further, the AC voltage may be better adjusted by changing the content of the adjustment according to a number of the adjustment. The AC peak-to-peak voltage may be brought close to the target range in the initial adjustment by repeating the sequence in the initial adjustment, even when the AC peak-to-peak voltage is significantly different from the target range at the power-on time. Therefore, the AC peak-to-peak voltage is not significantly different from the target range during a period between the initial adjustment and the subsequent adjustment, although the AC peak-to-peak voltage is not adjusted to within the target range in one adjustment. Alternatively, the controller may complete the initial adjustment after performing the sequence once to reduce the warm-up time.

Further, the adjustment amount of the AC peak-to-peak voltage may be different in the rough and the fine adjustments. Therefore, the AC peak-to-peak voltage may enter the target range in fewer adjustments. The AC peak-to-peak voltage may be efficiently adjusted by changing the target range in the rough and fine adjustments. The gross adjustment may be completed without switching the AC peak-to-peak voltage and in a shorter time by setting a broader target range than the fine adjustment.

Figure 20:
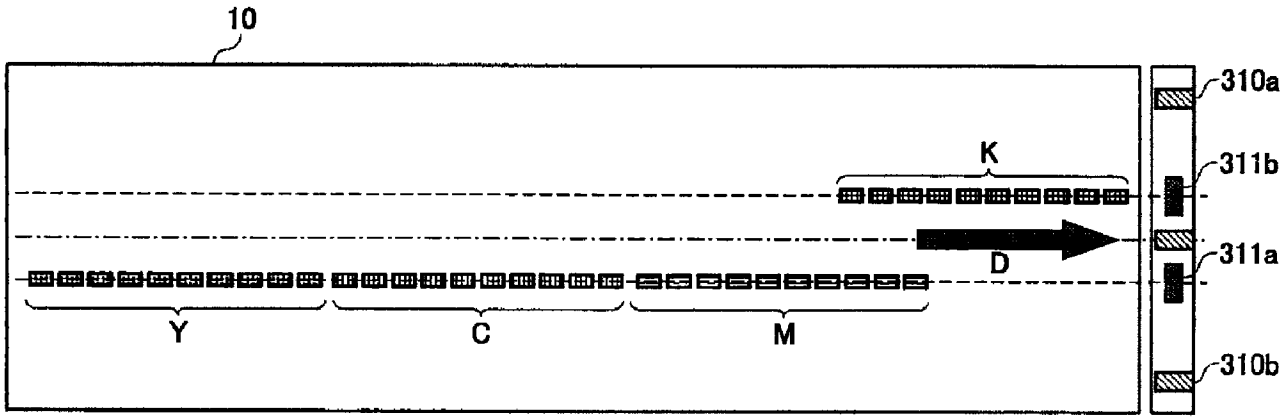
FIG. 20 is a sample detection pattern formed on an intermediate transfer belt during an image quality adjustment.

As illustrated in FIG. 20, the image forming apparatus 100 may further include position sensors 310*a* and 310*b* and density sensors 311*a* and 311*b*. The density sensors 311*a* and 311*b* detect density detection patterns Y, C, M, K formed on the intermediate transfer belt 10. The intermediate transfer belt 10 moves in a direction shown by arrow D. The image forming apparatus 100 adjusts an image forming condition (e.g., the charging DC bias, a developing DC bias, a LD power) so as to obtain a desirable image density based on results of the density detection.

Figure 21:
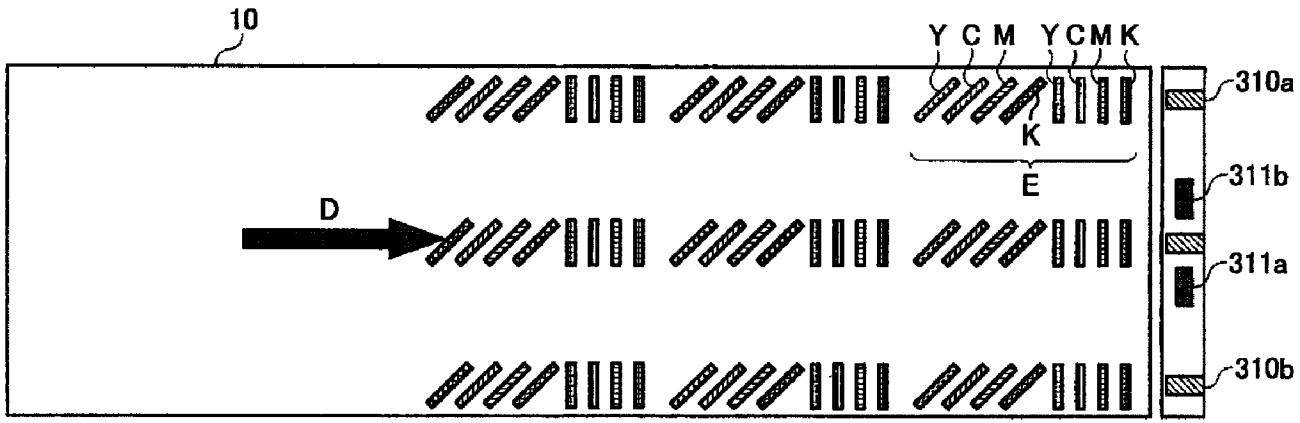
FIG. 21 is a sample detection pattern formed on the intermediate transfer belt during a position adjustment.

The position sensors 310*a* and 310*b* may detect a plurality of position detection patterns E formed on the intermediate transfer belt 10 as illustrated in FIG. 21. The image forming apparatus 100 may adjust a skew, registration deviations in a main scanning and a sub scanning directions, magnification errors in the main scanning and the sub scanning directions, a color displacement, etc., based on the results of the detection.

Figure 22:
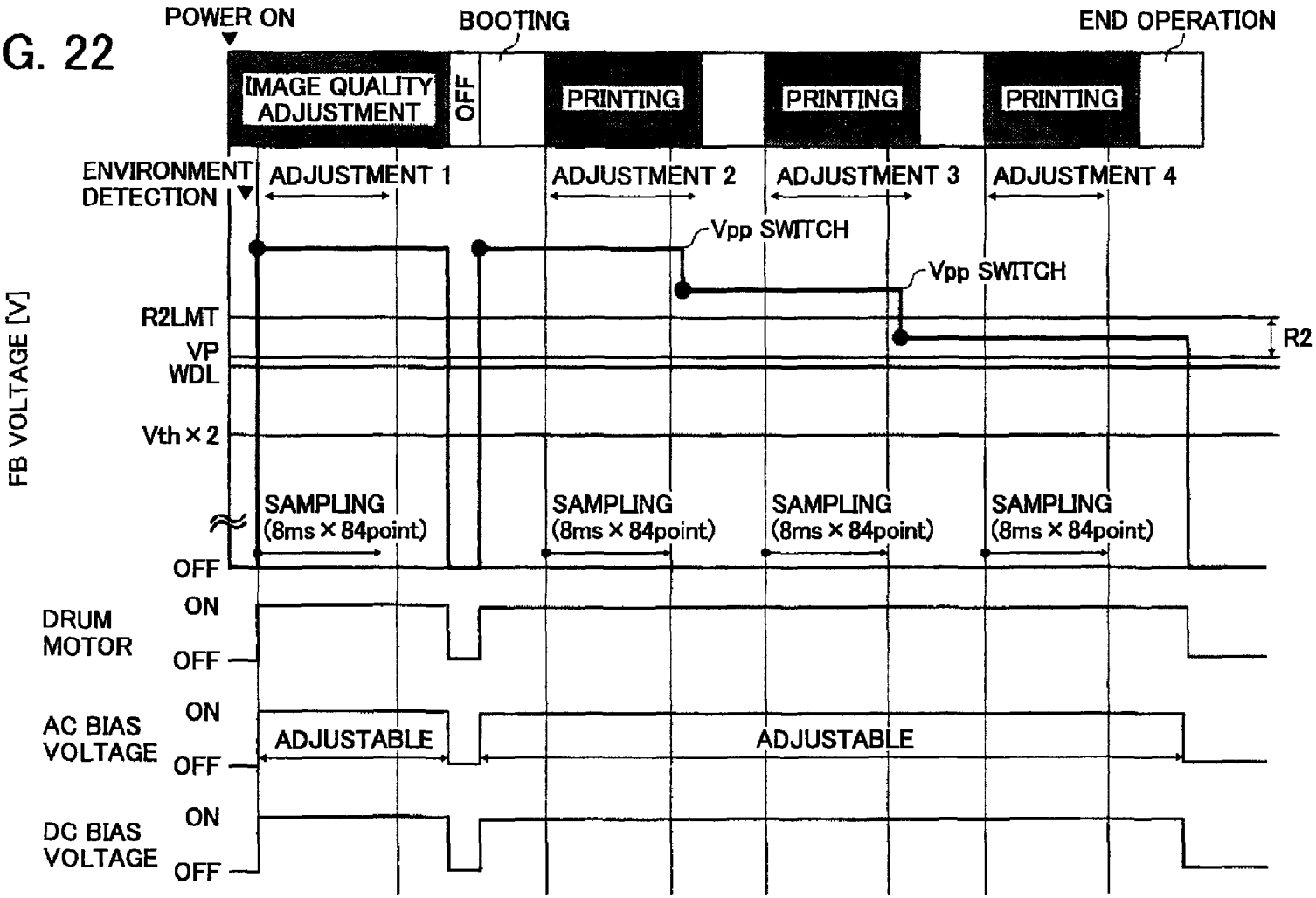
FIG. 22 is a timing chart when an initial adjustment of the AC voltage is performed in parallel with the image quality adjustment.

FIG. 22 is a sample timing chart when the adjustment of the AC peak-to-peak voltage is performed in parallel with the position adjustment. As illustrated in FIG. 22, the controller 4 detects an environmental condition and determines an initial AC peak-to-peak voltage after the power-on time. The controller 4 starts the position adjustment and forms the position detection pattern E. Simultaneously, the controller 4 may start an initial adjustment (gross adjustment) of the AC peak-to-peak voltage. The warm-up time may be reduced by performing the initial adjustment of the AC peak-to-peak voltage in parallel with the image quality adjustment or the position adjustment.

Alternatively, the adjustment of the AC peak-to-peak voltage may be performed in parallel with another adjusting operation, for example, an adjustment of the fixer 25.

The above adjustment of the AC peak-to-peak voltage includes processes of detecting an output value (FB value) of the AC voltage applied to the charging roller 2, determining whether or not the output value is within the target range, and switching the AC voltage when the output value is not within the target range. Alternatively, these processes may be divided.

Figure 23:
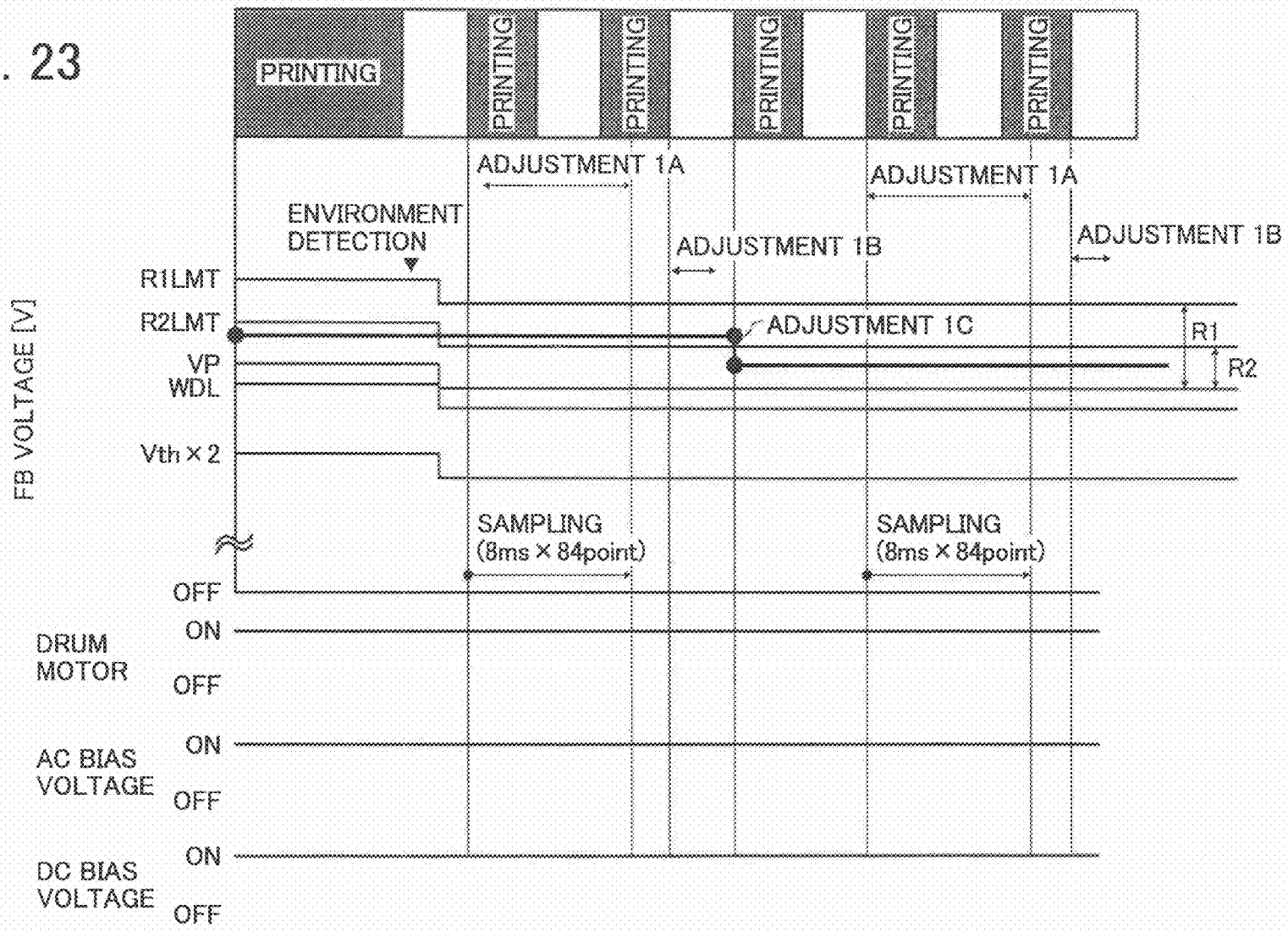
FIG. 23 is a timing chart when the adjustment of the AC voltage is performed in separate adjustment processes.
Figure 24A:
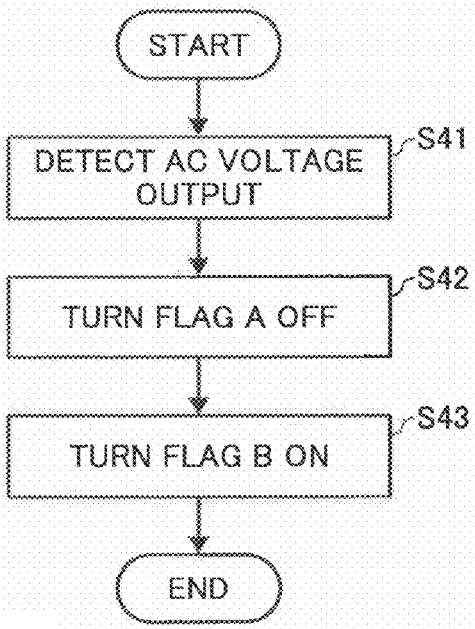
FIG. 24A is a flowchart of the adjustment process.
Figure 24B:
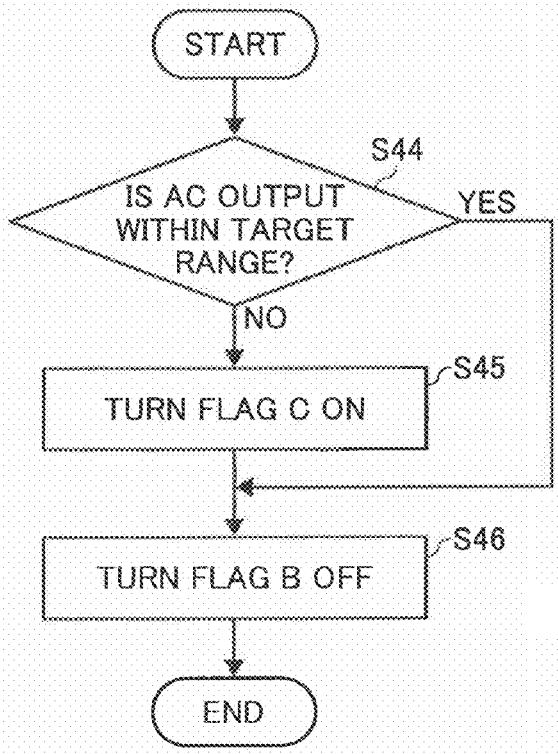
FIG. 24B is a flowchart of the adjustment process.
Figure 24C:
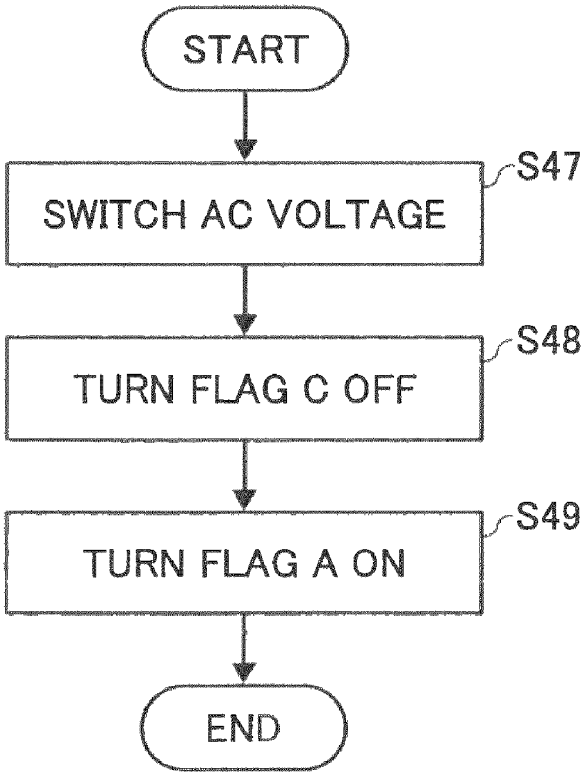
FIG. 24C is a flowchart of the adjustment process.

FIG. 23 is a sample timing chart of an exemplary embodiment in which these processes are performed as separate adjustment processes 1A, 1B, and 1C. FIGS. 24A, 24B, and 24C are flowcharts of the adjustment processes 1A, 1B, and 1C, respectively.

As illustrated in FIG. 23, the environment detector detects an environmental condition. In FIG. 23, the controller 4 changes the target value (lower limit Vp) after the environment detection because the environment changes from a previous adjustment. The controller 4 turns a flag A on at a predetermined or desirable timing, for example, when the target value is changed.

The controller 4 may start the adjustment process 1A when the flag A is on at a start of a printing operation and detects the output value of the AC voltage (detected FB value) at S41 as illustrated in FIG. 24A. The details of the output value detection are as described above. After the output value detection is completed, the controller 4 turns the flag A off at S42 and turns a flag B on at S43. The adjustment process 1A is completed.

Referring to FIG. 24B, the controller 4 checks whether or not the flag B is on at a predetermined or desirable timing, for example, when a printing operation is completed. When the flag B is on, the controller 4 starts the adjustment process 1B and determines whether or not the detected FB value is within the target range at S44. When the detected FB value is within the target range (YES at S44), the controller 4 turns the flag B off at S46 and completes the adjustment process 1B. When the detected FB value is not within the target range (NO at S44), the controller 4 turns a flag C on at S45, turns the flag B off at S46, and completes the adjustment process 1B.

Referring to FIG. 24C, the controller 4 checks whether or not the flag C is on at a predetermined or desirable timing, for example, at a start of a printing operation. When the flag C is on, the controller 4 starts the adjustment process 1C. The controller 4 calculates an adjustment amount of the AC peak-to-peak voltage and obtains a subsequent AC peak-to-peak voltage. The controller 4 switches the AC peak-to-peak voltage at S47, turns the flag C off at S48, and turns the flag A on at S49.

The adjustment processes 1A, 1B, and 1C are repeated in order each at a predetermined or desirable timing until the detected FB value enters the target range. After the detected FB value enters the target range, the adjustment processes 1A, 1B, and 1C are performed in order at certain intervals, for example, each time after a certain number of sheets are printed.

Productivity may be enhanced by separating the above adjustment processes 1A, 1B, and 1C into a plurality of adjustments. For example, image forming may be started after the adjustment process 1A is completed, without waiting for completion of the adjustment processes 1B and 1C.

The above-described adjustment of the AC peak-to-peak voltage may be applied to a contact charging method as well as to a non-contact charging method. In a case of a contact charging method, a cyclic variation of FB values depends more on a cycle of a charging roller than on a cycle of a photoreceptor. Therefore, it may be sufficient to sample the FB values for one rotation of the charging roller.

Although the adjustment amounts of the AC peak-to-peak voltage are calculated based on the FB value difference in an exemplary embodiment, the calculation is not limited to the above. For example, the adjustment amounts of the AC peak-to-peak voltage may be calculated based on a ratio between the target FB value (target output value) and the detected FB value (output value).

By setting the initial AC voltage applied to the charging roller after the power-on time to not less than twice the charging start voltage Vth, the adjustment of the AC peak-to-peak voltage may be performed in a range not less than twice the charging start voltage Vth.

Further, the initial AC voltage becomes closer to the target value by being determined according to the environmental condition. Therefore, the AC peak-to-peak voltage may be adjusted to the target range in fewer adjustments.

Further, the AC peak-to-peak voltage may match the environment in the image forming apparatus because the target value of the AC peak-to-peak voltage is determined based on an environment detection. Therefore, toner filming on the photoreceptor may be better controlled.

Further, the target value may be determined based on the environment detection and the table storing the environmental conditions and the target values in relation to each other. Therefore, a target value corresponding to the environmental condition may be easily set by referring to the table. Further, the AC peak-to-peak voltage may better match the environment by adjusting the AC peak-to-peak voltage when the target value is changed according to the environmental condition.

The AC voltage may be set to a proper value by adjusting the AC voltage so that the output current value enters the target range.

This application claims priority from and contains subject matter related to Japanese Patent Application No. JP2006-213758, filed on Aug. 4, 2006, the entire contents of which are hereby incorporated by reference herein.

Having now fully described the invention, it will be apparent to one of ordinary skill in the art that many changes and modifications can be made thereto without departing from the spirit and scope of the invention as set forth therein.

What is claimed is:

1. An image forming apparatus, comprising:

an image carrier configured to carry an image; and a charger to which a DC voltage overlapped with an AC voltage is applied as a charging bias to charge the image carrier, positioned in contact or contactlessly with the image carrier, wherein the AC voltage applied to the charger in an adjustment of the AC voltage is not less than twice a charging start voltage Vth at which the image carrier starts to be charged, the adjustment of the AC voltage being performed at least at a same time as a printing operation, and a peak-to-peak voltage of the AC voltage is adjusted so that an output value of the AC voltage applied to the charger enters a target range.

2. The image forming apparatus according to claim 1, wherein the AC voltage is adjusted in parallel with another adjusting operation.

3. The image forming apparatus according to claim 1, wherein an amount of an initial AC voltage applied to the charger after power is turned on is not less than twice the charging start voltage Vth.

4. The image forming apparatus according to claim 1, further comprising:

an environment detector configured to detect an environmental condition, wherein the target range includes a tolerance to a target value that is determined based on the detected environmental condition.

5. The image forming apparatus according to claim 4, further comprising:

a storage device storing a table in which one or more environmental conditions and target values are correlated, wherein the target value is determined based on the detected environmental condition and a correlation in the table.

6. The image forming apparatus according to claim 4, wherein the AC voltage is adjusted when the target value is varied based on the detected environmental condition.

7. The image forming apparatus according to claim 4, wherein the output value of the AC voltage applied to the charger is a current value and the AC voltage is adjusted so that the current value enters the target range.

8. The image forming apparatus according to claim 1, wherein the adjustment of the AC voltage includes gradually adjusting the AC voltage by setting the AC voltage to more than two values.

9. The image forming apparatus according to claim 1, wherein the adjustment of the AC voltage includes a gross adjustment and fine adjustment, the gross adjustment adjusting the AC voltage by a first amount, the fine adjustment adjusting the AC voltage by a second amount, and the first amount being greater than the second amount.

10. The image forming apparatus according to claim 2, further comprising:

a density detector to detect a density of the image formed on the image carrier, wherein the another adjusting operation includes forming a density detection pattern on the image carrier and adjusting an image forming condition based on a result generated by the density detector.

11. The image forming apparatus according to claim 2, further comprising:

a position detector to detect a position of the image formed on the image carrier, wherein the another adjusting operation includes forming a position detection pattern on the image carrier and adjusting at least one of skew, a registration deviation in main scanning and sub scanning directions, a magnification error in the main scanning and sub scanning directions, and a color displacement of the position detection pattern formed on the image carrier based on a result generated by the position detector.

12. The image forming apparatus according to claim 1, wherein the output value of the AC voltage applied to the charger is a current value and the AC voltage is adjusted so that the current value enters the target range.

13. An image forming apparatus, comprising:

an image carrier configured to carry an image;

a charger to which a DC voltage overlapped with an AC voltage is applied as a charging bias to charge the image carrier, positioned in contact or contactlessly with the image carrier; and an environment detector configured to detect an environmental condition, wherein the AC voltage applied to the charger in an adjustment of the AC voltage is not less than twice a charging start voltage Vth at which the image carrier starts to be charged, a peak-to-peak voltage of the AC voltage is adjusted so that an output value of the AC voltage applied to the charger enters a target range, and the target range includes a tolerance to a target value that is determined based on the detected environmental condition.

14. The image forming apparatus according to claim 13, further comprising:

a storage device storing a table in which one or more environmental conditions and target values are correlated, wherein the target value is determined based on the detected environmental condition and a correlation in the table.

15. The image forming apparatus according to claim 13, wherein the AC voltage is adjusted when the target value is varied based on the detected environmental condition.

16. The image forming apparatus according to claim 13, wherein the output value of the AC voltage applied to the charger is a current value and the AC voltage is adjusted so that the current value enters the target range.

17. The image forming apparatus according to claim 13, wherein a peak-to-peak voltage of the AC voltage is adjusted so that an output value of the AC voltage applied to the charger enters a target range.

18. An image forming apparatus, comprising:

an image carrier configured to carry an image; and a charger to which a DC voltage overlapped with an AC voltage is applied as a charging bias to charge the image carrier, positioned in contact or contactlessly with the image carrier, wherein an AC voltage is applied to the charger in an adjustment to adjust peak-to-peak voltage of the AC voltage, the AC voltage applied to the charger in the adjustment to adjust peak-to-peak voltage of the AC voltage is not less than twice a charging start voltage Vth at which the image carrier starts to be charged, the adjustment to adjust peak-to-peak voltage of the AC voltage being performed at a same time as a printing operation, and the peak-to-peak voltage of the AC voltage is adjusted so that an output value of the AC voltage applied to the charger enters a target range.

19. The image forming apparatus according to claim 18, wherein the target range is not less than twice the charging start voltage Vth.

* * * * *